US006112384A

United States Patent [19]

Barnes

[11] Patent Number: 6,112,384

[45] Date of Patent: Sep. 5, 2000

[54] MULTI-COLOR FIBER FLUFF PRODUCTS AND METHOD AND APPARATUS FOR MAKING SAME

[76] Inventor: Michael A. Barnes, 4715 Harding, Dearborn Heights, Mich. 48125

[21] Appl. No.: 09/055,650

[22] Filed: Apr. 6, 1998

Related U.S. Application Data

[60] Provisional application No. 60/043,078, Apr. 7, 1997.

[51] Int. Cl.[7] ..... D01G 13/00

[52] U.S. Cl. ..... 28/100; 28/299; 19/145.7

[58] Field of Search ..... 28/100, 299, 166, 28/140, 165; 19/98, 99, 145, 145.5, 145.7; 57/252, 255, 256; 428/357, 359, 361, 365, 374

[56] References Cited

U.S. PATENT DOCUMENTS

| | | | |
|---|---|---|---|
| Re. 258 | 2/1854 | Homes et al. | 19/145.7 |
| 67,226 | 7/1867 | Tainter | 19/145.7 |
| 310,803 | 1/1885 | Dyson et al. | 19/145.7 |
| 410,823 | 9/1889 | Denton | 19/145.7 |
| 411,367 | 9/1889 | Allison | 19/145.7 |
| 421,823 | 2/1890 | Duxbury | 19/145.7 |
| 421,824 | 2/1890 | Duxbury | 19/145.7 |
| 1,572,148 | 2/1926 | Kermin, Jr. | 19/145.7 |
| 1,637,139 | 7/1927 | Clow et al. | 19/145.7 |
| 1,675,916 | 7/1928 | Stewart | 19/145.5 |
| 1,759,260 | 5/1930 | Hoffmann . | |
| 1,848,370 | 3/1932 | Moore . | |
| 1,894,596 | 1/1933 | Moore . | |
| 2,159,992 | 5/1939 | Hunt . | |
| 2,280,536 | 5/1942 | Moore . | |
| 2,542,314 | 2/1951 | Lacotte . | |
| 2,694,907 | 11/1954 | Moore . | |
| 2,710,525 | 6/1955 | Brandt . | |
| 2,712,225 | 7/1955 | Moore . | |
| 2,757,529 | 8/1956 | Moore . | |
| 2,773,371 | 12/1956 | Moore . | |

(List continued on next page.)

FOREIGN PATENT DOCUMENTS

| | | | |
|---|---|---|---|
| 290448 | 5/1991 | Germany | 19/145.7 |
| 1427 | of 1875 | United Kingdom | 19/145.5 |
| 24897 | of 1898 | United Kingdom | 19/145.7 |
| 930873 | 7/1963 | United Kingdom . | |

OTHER PUBLICATIONS

Fairfield Processing Corporation Poly–fil . . . The Mark of Fine Craftsmanship.

*Primary Examiner*—Amy B. Vanatta

*Attorney, Agent, or Firm*—Reising, Ethington, Barnes, Kisselle, Learman & McCulloch, P.C.

[57] ABSTRACT

A method and apparatus for making a decorative mass of fiber fluff wherein a source of supply of staple fibers made of natural or synthetic textile fiber and arranged in continuous form, such as in a strand of yarn, are provided as a pattern array of discrete streams of different selected colors with the colors being uniform in each stream and comprising at least one base color and one contrasting color. The array stream of fibers is fed as an array of multiple strands of yarn into a carding operation wherein the fibers are brushed or carded from their input form into card or brush clothing to thereby only partially intermix fibers of at least two different colors in the bristles or wires of the card or brush clothing. The accumulated fibers are then removed film the clothing to form a pillow batt or roving having a streaked appearance representative of the original colors of the individual yarn strands, and with a partial intermixing and blending of the streaks of one color with those of another. The pillows, batts or roving are stretched, twisted or otherwise slightly further worked into a final fluff product having randomly dispersed bands, streaks and/or islands of one color softly merging into another color to produce a decorative candy-cane like appearance in the mass of final fiber fluff product. The novel fluff product can be packaged as is for use in artistic decorative projects, or spun into novel multi-color variegated yarn. Such yarn can be used to knit novel variegated color fabrics that then can be made in to novel variegated color fabric articles.

15 Claims, 16 Drawing Sheets

U.S. PATENT DOCUMENTS

| | | | |
|---|---|---|---|
| 2,805,564 | 9/1957 | Moore . | |
| 2,953,002 | 9/1960 | Hill . | |
| 2,953,912 | 9/1960 | Hill . | |
| 2,971,357 | 2/1961 | Hill . | |
| 2,993,351 | 7/1961 | Wheelock . | |
| 3,010,297 | 11/1961 | Hill . | |
| 3,020,774 | 2/1962 | Kullmann . | |
| 3,035,404 | 5/1962 | Roscoe . | |
| 3,071,820 | 1/1963 | Bettoni et al. . | |
| 3,071,821 | 1/1963 | Constantine et al. . | |
| 3,122,904 | 3/1964 | Brandt . | |
| 3,134,144 | 5/1964 | Still . | |
| 3,153,335 | 10/1964 | Hill . | |
| 3,154,934 | 11/1964 | Frishman . | |
| 3,188,834 | 6/1965 | Radtke . | |
| 3,251,097 | 5/1966 | Faw et al. | 19/145.5 |
| 3,299,672 | 1/1967 | Schmidt . | |
| 3,501,812 | 3/1970 | Schmidt . | |
| 3,563,058 | 2/1971 | Schmidt . | |
| 3,590,604 | 7/1971 | Beucus et al. . | |
| 3,710,597 | 1/1973 | Schmidt . | |
| 3,755,856 | 9/1973 | Banks . | |
| 3,839,114 | 10/1974 | Schmidt et al. . | |
| 3,952,372 | 4/1976 | Howell, Jr. | 19/243 |
| 4,006,610 | 2/1977 | Thore | 19/145.7 |
| 5,277,371 | 1/1994 | Bowns et al. . | |

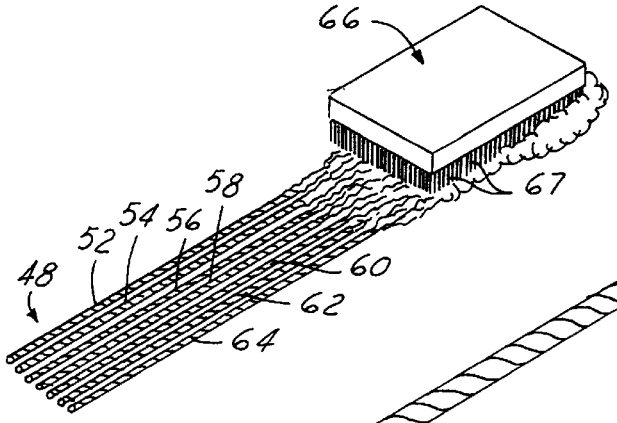
FIG.4
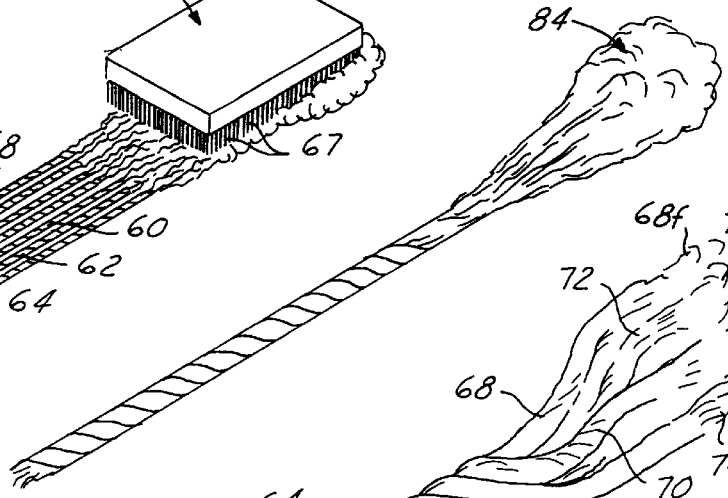
FIG.5
FIG.6
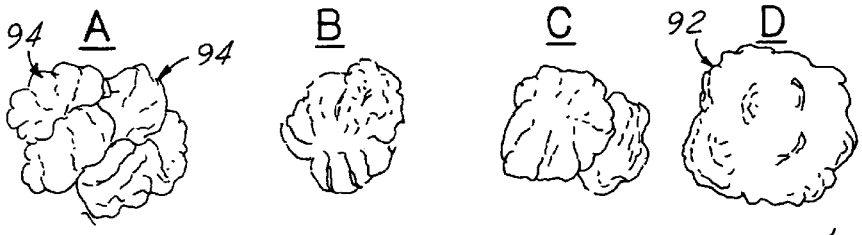
FIG.7
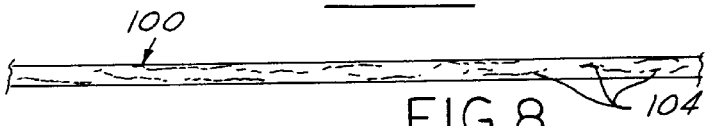
FIG.8
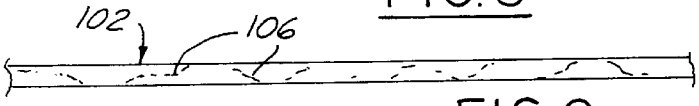
FIG.9
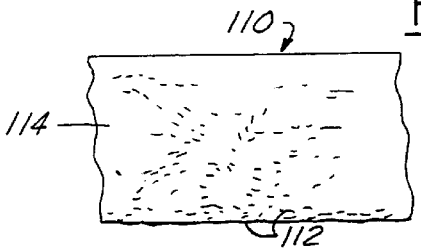
FIG.10

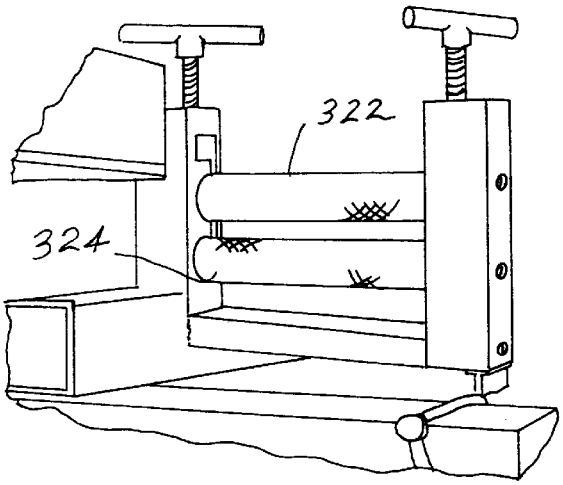
FIG. 43
FIG. 44
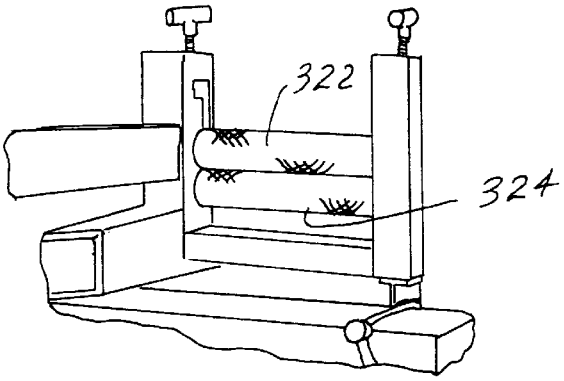
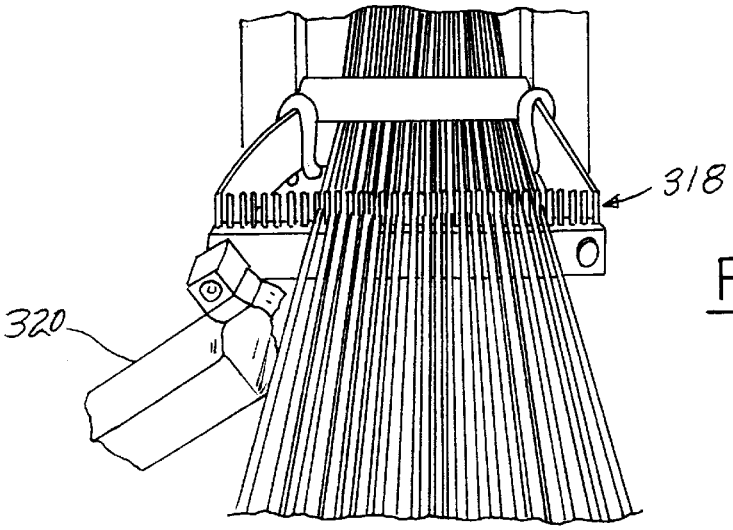
FIG. 45

MULTI-COLOR FIBER FLUFF PRODUCTS AND METHOD AND APPARATUS FOR MAKING SAME

This application claims the benefit under 35 U.S.C. § 119(e) (1) of provisional application Ser. No. 60/043,078 filed Apr. 7, 1997 pursuant to 35 U.S.C. §111 (b). This application also claims the benefit of the Disclosure Document No. 394,526 dated Feb. 28, 1996 and filed Mar. 6, 1996 (consisting of a three page letter from the inventor herein, Michael A. Barnes, of 4715 Harding, Dearborn Heights, Mich. 48125 addressed to "Disclosure Document Program, United States Department of Commerce, Patent and Trademark Office, Assistant Secretary & Commissioner of Patents and Trademarks, Washing (sic) Washington, D.C. 20231", including attachments Nos. 1–14). A separate letter accompanied the aforesaid provisional patent application identifying such provisional patent application and also the Disclosure Document, and acknowledgment of this letter is again respectfully requested pursuant to MPEP 1706.

FIELD OF THE INVENTION

This invention relates to fiber fluff materials and products useful as decorative material in arts and crafts projects, window dressing and display cases, is well as to yarn made from such material and knitted fabrics and apparel made from such yarn.

BACKGROUND OF THE INVENTION

It is a common practice among those working in the arts and crafts fields, such when creating miniature displays utilizing miniature figures and snow scenes as well as in constructing terrariums, to use a variety of commercially available fluffy-like fiber materials, such as those known as "fiber fill" consisting of a random fluffy mass of polyester fibers, or similar fluffy material made from natural fibers such as cotton in the form of cotton balls and the like. Examples of such products are "POLY-FIL"® brand polyester fiber fill made by Fairfield Processing Corporation of Danbury, Conn., "AIR-LITE" brand fiber fill material made by Air-Lite Synthesis of Pontiac, Michigan (Simplicity Pattern Company), "COSMETIC PUFFS" brand of cotton balls made by Acme/Chaston of Dayville, Conn., "Johnson & Johnson" Cotton balls made by J. & J. Consumers Products Company in Skillman, N.J., resin treated "POLY-FIBER" material made by Stearns Technical Textiles Co. of Cincinnati, Ohio, "PRETTY HAIR" brand fiber fluff made by Aldastar Corporation, Brooklyn, N.Y., "WAVY HAIR" brand decorative fluff made by One and Only Creations of Napa, Calif. and "FLUF-STUF®" brand fiber fluff material made by Village Sampler Industries Inc., distributed by Dayton Hudson Corp., Minneapolis, Minn. 55402 and "FEEL-O-FLEECE" brand fiber fluff material made by Plaid Enterprises, 6553 Warren Dr., P.O. Drawer "E", Norcross, GA 30091.

Such fluffy fiber materials are often also used in the making of baby quilts and accessories and quilted clothing and pillow stuffings as well as in home decorating and craft projects. Typically such ready-made materials are provided as a uniform mass of white fibers and less often as a uniform blend of two or more different colors and shades of fiber. However, if a multi-colored decorative effect is desired, a variety of different colors of ready-made fiber fill products must be assembled from an inventory of differentially colored uniformly blended stock of such materials. Alternatively, decorator spray paint of various colors can be applied in attempt to create a variegated color effect after the material is assembled on the scene. However, these existing materials and techniques are undesirable or unsuitable for many decorative craft or professional applications, both from the standpoint of undue cost and time consuming labor and less than desirable aesthetic effects being achievable.

The foregoing deficiencies of commercially available fiber fill materials led to the development of the products, methods and apparatus provided by the present invention. Some of the history of the development of the present invention as well as the disclosure of making and using an early embodiment of the present invention is set forth in the aforementioned Disclosure Document Number 394526, attached hereto at Appendix A and incorporated herein by reference.

OBJECTS OF THE INVENTION

Accordingly, among the objects of the present invention are to provide a new and useful fiber fill material, preferably made from synthetic fibers such a, polyester, in the form of a light fluffy, loose mass of randomly arranged fibers of a density of about 12 ounces per cubic foot. The new fiber fill material of the invention is preferably packaged as a product for convenient end use to provide a tangled mass of loosely interlocked fibers that is easily hand worked and arranged as decorative material. The fiber mass is preferably multi-colored to provide the different colors so that they visibly appear as swirls, highlights and blend off into one another as irregularly shaped random and random-appearing islands and streaks and swirls of one color of fiber intermingled with some of the fibers of the other color to create a highly pleasing and decorative "cotton-candy or candy cane" visual effect.

Another object is to provide a fiber fill multi-colored material of the above character, and new and improved apparatus for making the same, that may be readily spun into yarn to provide a multi-color variegated random color effect in the novel yarn thus produced that is representative of the two or more colors of the aforementioned multicolored fiber fluff product.

A further object is to provide novel textile fabrics and novel wearing apparel made from such fabrics as knitted goods that are knit from the aforementioned novel yarn to thereby provide a variegated random color effect in the apparel article containing randomly appearing colors yet proportioned in accordance with the color properties in the starting material yarn, which in turn contains randomly appearing color proportioned in accordance with the quantitative proportions of color in the starting materials of the fiber fill fluff product from which the yarn is spun.

Another object is to provide improved methods and apparatus for making the aforementioned decorative fiber fluff material, products, yarn and fabrics and wearing apparel and other fabric articles.

BRIEF DESCRIPTION OF THE DRAWINGS

These and other objects, features and advantages of the present invention will become apparent from the following detailed description, materials set forth in Appendices A, B, C and D appended and referenced in the detailed description of the aforesaid provisional application and incorporated herein by reference, from the appended claims and from the accompanying drawings wherein:

FIG. 4 is a simplified perspective view illustrating a brushing or carding step of the method.

FIG. 5 is a fragmentary perspective view showing one of the four-ply yarns of FIG. 4, but greatly enlarged there over and illustrating the "teased" bloom of fibers at the downstream free end resulting from the brushing step.

FIG. 6 is a fragmentary perspective view of the four-ply yarn of FIG. 5, greatly enlarged thereover, and illustrating the unraveling of each of the four plies of the four-ply strand at the downstream end occurring as a result of the brushing step of FIG. 4.

FIG. 7 is a simplified sequential view illustrating successive stages in one phase of the method of formation of the final fluff product.

FIG. 8 is a simplified fragmentary plan view of a multi-ply strand of yarn spun from the final fluff product of the invention.

FIG. 9 is a fragmentary plan view of another embodiment of a multicolored yarn spun from the final fluff product of the invention.

FIG. 10 is a fragmentary plan view of a piece of fabric knitted from the yarn of FIG. 9.

FIGS. 37–58 and 60 are color photo prints showing further details of the construction, operation and use, and resulting end product of the method of the invention as described and illustrated in conjunction with FIGS. 23–36, FIGS. 37–60 being more particularly described as follows:

FIGS. 37 and 38 are close-up views of the clamp 264 and shown respectively therein in the carriage-raised, clamp-locked position and the carriage-lowered, clamp-released position for separation of the brush belts.

FIGS. 39 and 40 are views illustrating the manipulation of the operating handle 268 of the clamping mechanism 264 with the left hand while operating the handle 284 of the belt crank lever 270 to lower the lower brush belt 202' from engagement with the upper brush belt 200' (FIG. 39) to the fully separated position of the belts (FIG. 40).

FIGS. 41 and 42 are close-up views of the downstream end of the components of the dual rotary brush belt mechanism 200' and 202' illustrating the lower run of the upper card cloth belt, upper and lower runs 205 and 302 of the lower belt, associated support plates 238, 298 and 300 and the knurled drive rolls 206' and 208' (FIG. 41) and the driving and driven spur gears 306 and 308 in mesh (FIG. 42).

FIGS. 43–47 are close-up views illustrating in more detail the construction, arrangement and yarn strand feed set-up of the nip rolls 322 and 324, guide pin comb bar and pins 318, comb cover plate 320 in open position (FIGS. 43, 45 and 46) and in closed position (FIGS. 44 and 47).

FIG. 48 is a view illustrating the downstream ends of the yarn strands removed from the card belts to illustrate the unraveling and fluffing out of the ends of the yarn strands as subjected to the action of the dual rotary brush belts of the carding mechanism as the strands are fed thereinto.

FIGS. 49–56 illustrate the hand operations of removal of the carded batt from the brush belts (FIGS. 49, 50 and 51), laterally hand stretching the batt to widen and fluff it out (FIGS. 52 and 53), giving the batt a shake once or twice with the hand (FIGS. 54 and 55), and then stuffing the batt in a transparent plastic bag (FIG. 56).

FIGS. 57 and 58 illustrate side-by-side the finished decorative fiber fluff product as packaged for sale under applicant's trademark "DECO FLUFF", the left hand packages having been made pursuant to the hand method and described in conjunction with FIGS. 4–7, and the right hand packages having been made pursuant to the dual rotary brush second embodiment method and machine described in conjunction with FIGS. 23–56, utilizing the same color code yarn strand input for each of the products illustrated side-by-side.

FIGS. 59 and 60 are respectively a diagrammatic drawing and color photo print illustrating the set-up on table 120 for utilizing formula number 79, with the color quantities and identity labeled in FIG. 59 in accordance with the respective spool stations on feed table 120, and FIG. 60 illustrating the resultant product as produced in the second working embodiment in accordance with the teachings of FIGS. 23–51 as described and illustrated herein.

DETAILED DESCRIPTION OF PRESENTLY PREFERRED BUT EXEMPLARY EMBODIMENTS OF THE INVENTION

Figure 1:
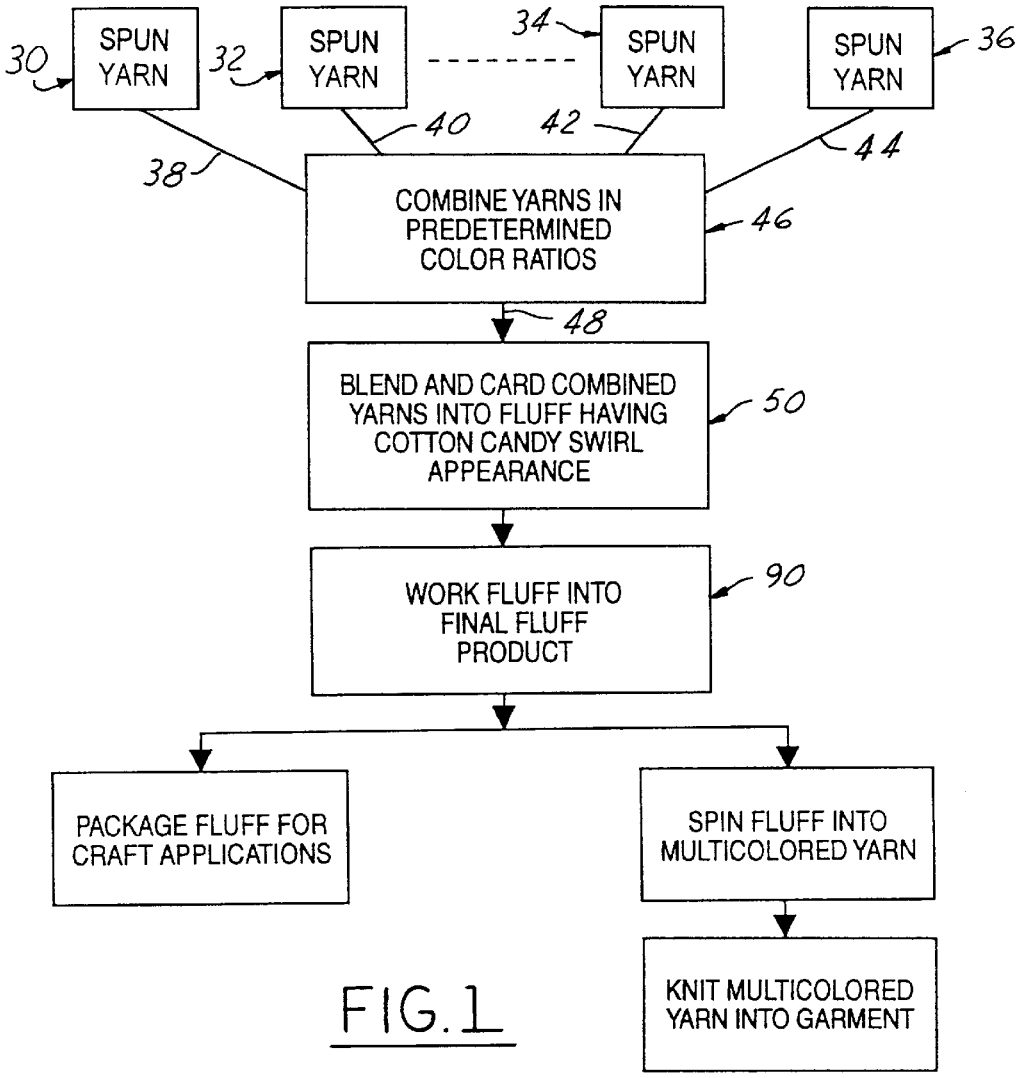
FIG. 1 is a schematic block diagram of one exemplary but preferred embodiment of a method or process of making both the packaged fluff product of the invention for craft applications, as well as making yarn from the final fluff product and making a knitted multi-colored garment from the yarn product of the process.

Referring to FIG. 1, one embodiment of the method of the invention for making three forms of final product of the invention is illustrated in block diagrammatic form. As a first step, the method contemplates providing a source of supply of plural streams of contiguously attached staple fibers individually provided at separate supply stations, such as stations 30, 32, 34 and 36. For example, each of the stations 30–36 may consist of a spool of spun yarn fed as individual multi-ply strands 38, 40, 42 and 44 respectively to a combining station 46 wherein a condensed, side-by-side array of the individual yarns, designated at 48, is formed and fed to a blending and brush carding station 50. Preferably each yarn strand 38–44 is four-ply yarn made of 100% acrylic fibers such as that sold under the brand name "VONNEL" and made up and sold as yarn such as that marketed under the brand names "Love Knit" at K-mart stores, "Fashion Knit" at Wal-Mart stores and/or "Pop-N-Yarn" sold at Michael's Crafts.

The multiple color scheme of the final variegated fiber fill fluff product of the invention is a function of the individual colors of each of the single-color yarn spools provided at the supply source stations 30–36. Accordingly, individually distinct and different final products can be formed in accordance with predetermined color-coded supply formulas for yarn as set forth on pages 1, 2 and 5–7 of Appendix B attached to the aforesaid provisional application and incorporated herein by reference. As will be seen from formulas F and G on page 7 of Appendix B, in some instances a given formula calls for one of the supply stations 30–36 to be provided with one half of a four-ply strand, i.e., a two-ply strand of yarn of a given color, e.g., lavender.

In one embodiment of the method of the invention the same is practiced entirely by hand, i.e., manually. In this embodiment, when practiced in accordance with a color-code formula that specifies an input of twenty strands of yarn, the first step is to assemble for example 100 feet of yarn arrayed in twenty strands, each 5 feet in length. These twenty strands are laid in a side-by-side array 48 on a suitable horizontal flat surface 80 of a suitable support 82 (FIG. 16) as indicated by the yarn strands shown in simplified form in FIG. 4 at 52–64, wherein for clarity only seven strands are shown instead of twenty. Assuming a final product in accordance with formula Number 65 on page 5 of Appendix B is to be produced, two of the twenty strands, such as strands 58 and 68, are red yarn made up entirely of uniformly colored red fibers, whereas the remaining eighteen strands of the plural strand array 48 as represented by the strands 52–56 and 62, 64 in FIG. 4, are white yarn made up entirely of uniformly colored white fibers. Such a side-by-side array 48 arranged by a hand lay up is shown in color photo-print No. 1 of Appendix C attached to the aforesaid provisional application, Appendix C containing color photo prints Nos. 1–31 and being incorporated herein by reference. The manual procedure thus accomplishes the supply and combining steps of stage blocks 30–36 and 46 of FIG. 1.

In the next step of this manual method embodiment, the fibers from the array 48 of yarns strands 52–64 are partially blended in a brush carding operation, as indicated schematically in FIG. 4 by the hand-held brush 66. This corresponds to the operation performed at method stage block 50 of FIG. 1. By way of example, a commercially available hand-held dog brush such as shown in Attachment No. 2 of Appendix A and in photo prints Nos. 2–14 and 16 and 17 of Appendix C, is used as brush 66. Brush 66 thus has a wire card cloth measuring 3 inches long and 1¼ wide with four-hundred and thirty-two wire bristles attached thereto in uniform array. The bristles are each ½ inch in length and are bent at approximately half length to have a forward rake at their leading ends as conventionally provided in such commercially available dog brushes.

Figure 19:
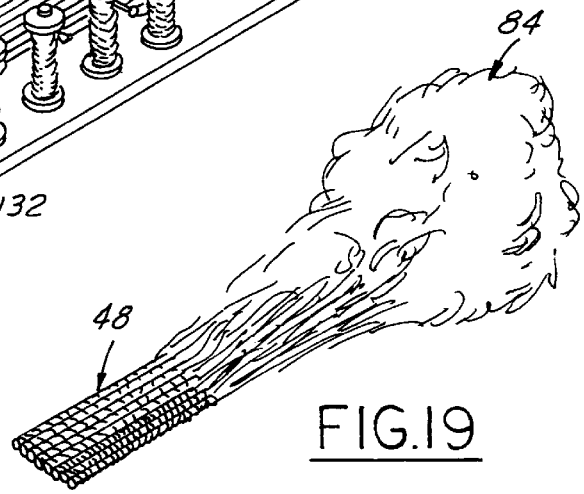
FIG. 19 is a fragmentary perspective view illustrating the effect of brush carding of a plurality of multi-ply strands of yarn using the apparatus of FIGS. 17 and 18.

In the partial-blending-by-carding stage 50 of the method, the array 48 of yarn strands are disassembled at their leading end by restraining or holding fixed the trailing ends upstream of the free ends of the yarn strands of array 48, as by hand holding or knotting into a ponytail to facilitate such hand holding, or by press-down restraint of the array while the array is supported on a firm flat stationary surface. The disassembling of the pre-spun yarn strands is accomplished by engaging a given length of the downstream leading free ends of the array with the hand brush 66, the brush bristles 67 being pressed firmly down into the array 48. Brush 66 is then moved in a brush stroke in the direction of the longitudinal axis of the strands 52–64 toward their leading free ends until the brush has completely cleared these leading ends of the array. The card brushing action is thus initiated in laterally unrestrained loose ends of the strand array 48. After many replications of the unidirectional brushing a loose bundle of brushed fibers begins to accumulate at loose free ends of the strands, thereby creating the "ponytail" or cluster 84 shown simplified in FIGS. 4, 16 and 19 and seen progressively being formed in photo prints Nos. 2–7 of Appendix C. This unidirectional brush stroke action is repeated with a sufficient number of brush strokes to fill or load the brush bristles with loose fibers combed or carded into the brush bristles directly from raking through and along the multiple yarn strand array 48 and from the ponytail 84. This sequence of brush carding to load the brush 66 is shown generally sequentially in photo prints Nos. 2–11 of the aforesaid provisional application Appendix C. The initial effect on the strand free ends of the initial brush strokes of this step of the method is indicated in simplified form in FIG. 6. As shown in FIG. 6, one of the strands 64 of the array 48, containing the four plies of sub-strands 68, 70, 72 and 74, first becomes unraveled toward the sub-strand leading ends in a first stage of disassembly, and then they feather out at **68*f*–74*f*** at their free ends due to the raking action of the brush bristles.

Figure 2:
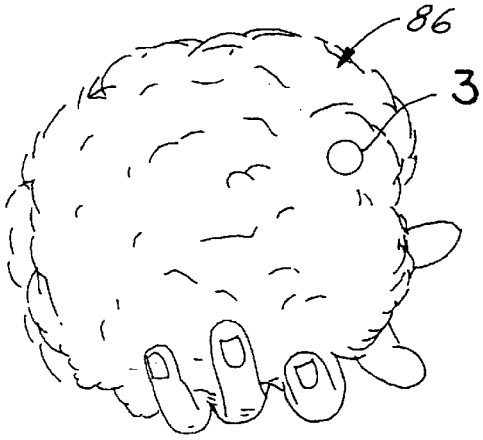
FIG. 2 is a perspective view of hand-held ball of the final fluff product ready for use or packaging for use.
Figure 3:
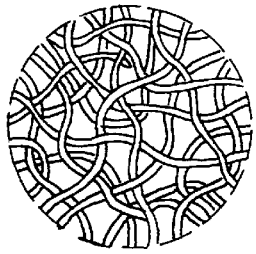
FIG. 3 is a greatly enlarged view of the portion of FIG. 2 encompassed by circle 2 of FIG. 2.

Once the bristles 67 on brush 66 have become fully loaded with fibers separated from the strands ends by the brush carding action occurring in the foregoing repetitive brush strokes, the final substep of stage block 50 is to separate the fibers from the bristles in one clump to form a loose but unitary pillow of fluffy soft fibers which, when taken out of the dog brush 66 of the foregoing example, typically measures about 4½ inches wide by about 2½ inches deep by about two inches high. One such pillow is shown at 86 in FIG. 2 being hand-held. The removal of the full load of fibers from the brush to form such a pillow 86 is shown sequentially in photo prints Nos. 12–14 of Appendix C. This pillow formation procedure is then repeated to sequentially collect full loads of fibers on the brush bristle by the repetitive brush strokes described previously, typically requiring about one hundred and ten unidirectional strokes of the brush to accumulate one pillow load on the brush. Preferably, about twelve fluff pillows 86 are thus produced to complete stage block 50 in preparation for commencement of the next successive stage of the manual method, indicated at block 90 in FIG. 1, in which the fluff pillows are worked into the final fluff product. Twelve such pillows 86 are shown laid out in a table top array in photo No. 1 of Appendix D attached to the aforesaid provisional application and incorporated herein by reference.

Figure 11:
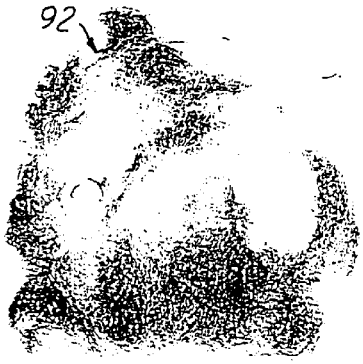
FIG. 11 is a duplicating machine copy of an actual final fluff product corresponding to that of FIG. 2 and the final stage of FIG. 7, the copy being made on a black and white Xerox copy machine.

After the aforementioned twelve fluff pillows 86 have been accumulated as described previously, the next stage (indicated by stage block 90) is to stretch out each pillow, assemble the pillows cris-crossed in a stack resembling a kindling wood pile, and then to hand work them into the final fluff product comprising a mass of soft fluff such as shown at 92 in FIG. 11, and illustrated in one example in photo print No. 29 of Appendix C and in photo print copy No. 19 of Appendix D. The steps of individually preparing each of the pillows, arraying them in a "kindling wood pile" and then working this pile into the final fluff mass 92 is shown by way of one example in photo prints Nos. 18–28 of Appendix C and in photo copy prints Nos. 1–18 of Appendix D.

As more particularly set forth in the captions accompanying photo prints Nos. 1–19 of Appendix D, the pillows are individually stretched out by hand to a length of about 8 inches and laid down on a supporting surface such as a table (Appendix D, No. 2). This is repeated with the second pillow and it is placed next to the first stretched pillow, parallel thereto in a side-by-side relationship (Appendix D, No. 3). Then the third pillow is likewise stretched out and placed on top of the first two side-by-side pillows with its longitudinal axis perpendicular to that of the first and second pillows (Appendix D, No. 4). The fourth pillow then is stretched out in like manner and laid on top of bottom two pillows with its axis parallel to the laterally adjacent third pillow to thus form the second layer of the kindling wood pile (Appendix D, No. 5).

This individual stretching out of the successive pillows and lay up in kindling wood fashion is repeated through twelve pillows to build a six layer stack of pillows (Appendix D, Nos. 6 and 7). The foregoing procedure is also illustrated in photo prints Nos. 19–24 of Appendix C, although in somewhat less detail.

The next procedure in stage 90 of working the fluff into the final fluff product is to further randomize the pillow material of the fluff pile array in order to produce the one loosely coherent mass of soft fluff 92 of FIG. 11. This is done by kneading the kindling wood pillow assembly as shown in photo prints Nos. 25–28 of Appendix C, and in more detail in photo print copies Nos. 8–19 of Appendix D. In this kneading procedure as done manually by one person, the assembly of stacked-up pillows is bodily picked up as a pile with both hands held close together and facing down at an angle as shown in photo copy No. 8 of Appendix D. The manipulator then squeezes a portion of the pile with the forearms and pulls and stretches the portion in his hands, while rotating the hands upwardly and bringing the sides of the hand together, as shown in photocopy No. 9 of Appendix D. The upward finger squeeze and hand pull motion is continued, pulling slightly wider at the top of the hands (photo copy No. 10, Appendix D), then continuing pulling slightly wider while keeping the wrists close throughout the entire motion (Appendix D, No. 12).

Then the kindling pile as thus initially worked is placed on a support surface, the pile rotated 45° about a vertical axis and then regrasped to repeat a second squeeze, rotate pull action, repeating the action as described with reference to Appendix D, Nos. 8–11 and shown in photo copies Nos. 13, 14, Appendix D. Then this mass thus worked a second time is placed down, rotated another 45° in the same direction as previously about a vertical axis. The hand grasp squeeze and pull action is then further repeated, as indicated in photo copies Nos. 15 and 16, Appendix D. Again, the pile as thus worked a third time is placed down, rotated another 45° and the squeeze, rotate and pull action again repeated a fourth time, as indicated in photo copies Nos. 17, Appendix D. After this fourth working is completed, the pile is again placed down, rotated another 45° in the same direction as previously, and this squeeze, rotate wrist and pull action repeated a fifth time, as indicated in photocopy No. 18, Appendix D. After this sequential pile rotation and hand and wrist kneading has been repeated at total of eight times the finished of mass of fluff 92 results, as shown in photo print No. 29 of Appendix C and photo copy No. 19 of Appendix D; see also FIG. 11. The working of the fluff pillows 94 into the single final coherent fluff mass 92 is also indicated in simplified form in the sequential view of stages A, B, C, and D in FIG. 7.

The foregoing method steps performed in block diagram stages 46, 50 and 90 of FIG. 1 typically requires about 30 minutes and results in a fluff mass 92 weighing under 1 ounce and appropriately sized to fit in a one quart size plastic bag (preferably transparent and with a zipper seam or stapled closed to a display hang tag label), as shown in photo prints Nos. 30 and 31 of Appendix C, thus being packaged ready for storage, display, sale and/or use.

As will be seen in FIG. 11, as well as from Attachment No. 3 of Appendix A, photo copies Nos. 29, 30 and 31 of Appendix C and photo print copy No. 19 of Appendix D, a fiber film fluffy loose mass of material 92 formed as a product of the foregoing method provides a multi-color array of fibers in a random dispersion in which the different colors visibly appear as swirls and irregular island highlights. The different colors of fibers partially blend off into one another yet remain somewhat distinguishable as irregularly shaped random appearing islands, streaks and swirls of one color of fiber intermingled with some of the fibers of the other color, thereby creating a highly pleasing and decorative "candy-cane" visual effect.

The uses for this product of decorative fiber fluff are many and the colors are unlimited. The coherent fluff mass 92 is readily packaged in see-through plastic bags as indicated previously and as shown in attached appendices. The material can thus be stuffed, it can be fluffed out, it could be glued, spray painted, stretched, bunched or layered as desired for use in such arts and crafts applications as decorative centerpieces, baskets and vases, on plastic canvases, on wearing apparel such as hats, as well as displayed in soap dishes and on or as wall hangings. Indeed, the use of the product is limited only to the individual decorator's imagination and artistic ability.

In addition, the fluff mass 92 provides a very desirable and unique starting material for being spun by conventional spinning processes into yarn strands which are then twisted into multi-ply yarn strands. Due to the random nature of the candy-cane-like array of the separate and distinct colors of the fibers in mass 92, the yarn thus created has a random but more condensed color appearance throughout., providing a very pleasing multi-color yarn effect. Two yarn strands thus made are shown as the multi-ply strands 100 and 102 in FIGS. 7 and 8 respectively. As indicated in simplified diagrammatic form in these views, the "highlight" color such as red appears as a random dispersion at areas indicated at 104 in FIG. 7. When the color code formula entitled "Mother of Pearl" set forth in Appendix B, page 6 is employed, and thus contains a base color of white with small proportions of six additional colors, i.e., baby pink, yellow, mint green, baby blue, peach and lavender, a very subdued but random blend of the formula-specified colors appear in the yarn 102, as indicated by areas 106 in FIG. 8.

This new yarn product of the invention is very suitable for further use in knitting multi-color knit fabrics, as indicated by the novel fabric shown in simplified form in FIG. 10 at 110. This knitted fabric again will have very subdued and random areas of the formula accent colors appearing as highlights at 112 in the major base color indicated at 114.

This knit fabric 110 then can be fashioned into various items of wearing apparel. One example of a women's sweater knitted from the "Mother of Pearl" formula yarn as so produced is shown in attachment No. 4 of Appendix A. As can be readily seen, when the novel yarn 102 is knitted into a garment or sample squares of knit fabric, the results are very beautiful and unusual. Likewise, attractive woven fabric can also be made from the yarn by conventional weaving methods and apparatus.

Figure 13:
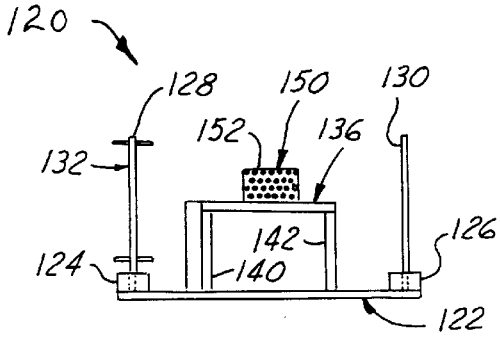
FIGS. 12 and 13 are plan and front elevational views respectively of one embodiment of apparatus of the invention for feeding multiple strands of yarn to a single condensing output for feeding therefrom into the brushing or carding stage of the method of the invention.
Figure 12:
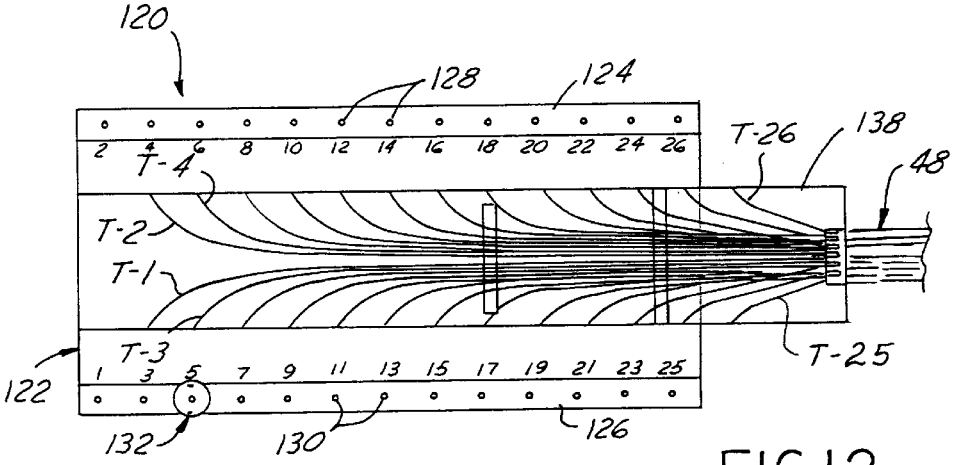
Figure 14:
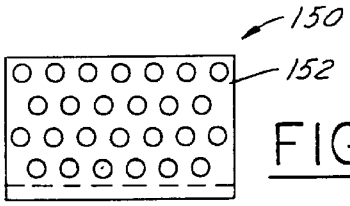
FIGS. 14 and 15 are front and side elevational views of a yarn strand condensing guide bracket used in the apparatus of FIGS. 12 and 13.
Figure 15:
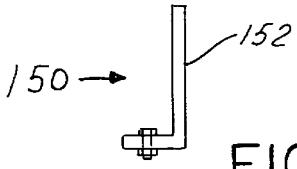
Figure 18:
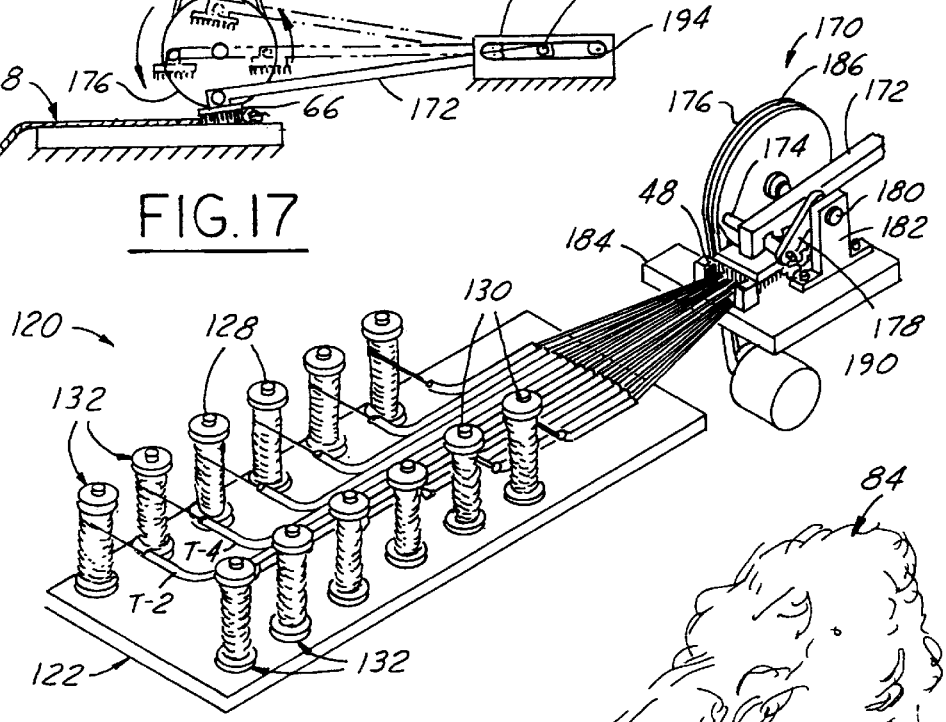
FIG. 18 is a fragmentary perspective view of the brush card mechanism of FIG. 17 shown in conjunction with a simplified view multiple yarn of the feed table set-up of FIGS. 12–15.

The general method of the invention as outlined in block diagram form in FIG. 1 can be practiced entirely by hand as described hereinabove, if so desired. However, the method is also subject to mechanization, as now will be evident to those skilled in the art from the foregoing description. Along this line, the invention also contemplates mechanizing the supply and combining stages 30–36 and 46 represented in FIG. 1 by the provision of an initial set up and feed apparatus. In one embodiment this comprises the feeder table described on page 2 in Appendix A and shown in Attachment 13 thereto, as well as in FIGS. 12–15 of the appended application drawings. This feeder table apparatus is also shown simplified form in the perspective view of FIG. 18. Basically, this feeder table apparatus, designated generally 120 in FIGS. 12, 13 and 18, comprises a table 122 to provide a flat platform on which a pair of spindle support bars 124, 126 are suitably affixed, one along each of the opposite longitudinal edges of table 122 and extending parallel to one another. Bar 124 supports a row of upright spindle pins 128 equally spaced therealong. Likewise an upright row of spindle pins 130 are provided at equally spaced increments along support bar 126. Each spindle position along each bar may be suitably identified, as by the numbering shown in FIG. 12, to visually indicate and facilitate placement of selected spools of yarn individually at each spindle. Suitable conventional yarn winding spools such as spool 132 shown mounted at station No. 5 on bar 126 in FIGS. 12 and 13, are provided and each have a hollow spindle tube which drops down onto the associated spindle pin and permits rotation of the spool on the stationary pin. Each spool 132 contains a single color winding of the aforementioned yarn starting material. The spools as shown in FIG. 18 thus are representative of the given color coded formula for the pre-determined decorative fluff mass 92 to be produced by the method and apparatus of the invention. Preferably, the yarn is pre-wound on each spool 132 in a conventional manner to facilitate pull-off unwinding of the yarn from the spool without tangling.

As shown in simplified form in FIGS. 12 and 13, feeder table apparatus 120 also includes a central platform 136 comprising a horizontal table top 138 mounted centrally of table 122 by supports 140 and 142 so as to extend lengthwise of table 122 and protrude beyond the output end (right hand end as viewed in FIG. 12). As indicated diagrammatically in FIG. 12, a series of hollow plastic guide tubes are mounted in left and right hand bank arrays on the upper surface of table 138 and correspond in number to the respectively associated number of spindle pins 128 and 130. As shown in FIG. 12, tube T-1 has its open entrance end aligned with the spool position on spindle pin No. 1. The next tube T-3 of this bank has its entrance end aligned in the direction of spindle pin No. 3. Likewise, tube T-2 of the left bank is aligned to point to spindle pin No. 2 and tube T-4 has its entrance end aligned to point to spindle pin No. 4 etc. Preferably, these tubes are supported by table 136 at an elevation aligned with the mid-point of the vertical elevation of each associated spool 132 when mounted on its associated spindle pin 130.

The trailing or exit ends of each of the feeder tubes are individually registered into an associated mounting opening in an upright condensing bracket fixture 150 mounted on table 136 at its output end, as shown in FIGS. 12 and 13. Fixture 150 thus has an upright plate 152 provided with four interconnected or staggered rows of holes which, in the example shown, are numbered 1–26 to correspond with the individually associated ones of the array of twenty-six feeder tubes T-1 through T-26.

In set-up and use of the feeder table apparatus 120 in performing the method of the invention to make a predetermined color pattern array 48 of the plurality of the multi-ply yarn strands for feeding into the above described brush carding stage, an array of yarn-wound spindles 132 are selected in accordance with a given one of the aforementioned color code formulas. These spindles of yarn are individually mounted on the associated spindle pins 128, 130 in a predetermined manner in accordance with the color code formula selected. For example, if the formula calls for a total of twenty multi-ply strands of yarn, twenty appropriate wound yarn spools 132 are selected and suitably mounted on the feed pins 128 and 130 of apparatus 120. Assume the array 48 of starting material indicated by the example as shown in Appendix C, is to be a two-color (red and white) formula consisting of a majority of multi-ply yarn strands 52–56 and 62–64 of a solid white color but in accordance with the twenty-strand Formula No. 65 set forth on pages 2 and 5 of Appendix B. Therefore eighteen spools of multi-ply strands of white yarn and two spools of multi-ply strands of red yarn are selected, and these yarn wound spools are individually mounted on twenty of the spindle pins 128, 130. Preferably, the two minority or contrast color red yarn spools are mounted on side-by-side spindles so as to feed into adjacent feed tubes so that two strands of red yarn exit bracket 152 adjacent one another. For example, tubes T-1 and T-2 at associated spindle positions Nos. 1 and 2 may be selected for the red yarn spools 18. The remaining tubes eighteen (out of the total of twenty-six tubes) and associated pins 128, 130 are then utilized to spindle the eighteen white yarn spools thereon.

The leading end of the yarn from each spool winding is individually fed into the entrance end of each associated feed tube and then drawn through the tube to exit therefrom at the outlet end bracket fixture 150 to thereby provide the condensed, flat array 48 of yarn exiting from fixture 150 as shown in FIG. 12. Each yarn strand may be initially fed through the associated tube by connecting it to a feeder wire drawn through the tube, or a vacuum supply source may be applied to the face of aperture plate 152 to air draw and suck the yarn through each associated feeder tube. The installed set up of the yarn array feeder apparatus 120 is also indicated in simplified form in FIG. 18 wherein the feeder tubes are merely arrayed flat on table 122 and their inlet ends bent up to point in the appropriate inlet direction for receiving the yarn from each associated yarn spool, and wherein condensing bracket 150 as well as tube support table 136 are omitted.

It will be seen that the feeder table apparatus 120 facilitates initial set-up of a given plural color code formula for making the decorative fluff end product desired. The inventory of yarn spools is likewise numbered to correspond with the spindle pin stations. The coded color of the spindle array can be set up on a spindle array number chart for use in selection and set-up as desired. Once set-up, the coded yarn array 48 can be manually or mechanically withdrawn from the feeder table apparatus into the brush carding station for working by the above described manual method or by mechanical means and mechanisms. For example, conventional opposed fluted feed rollers and/or drafting sections (not shown), as well understood in the art, can be employed to control feed and restrain advance of the array into the carding station.

Figure 16:
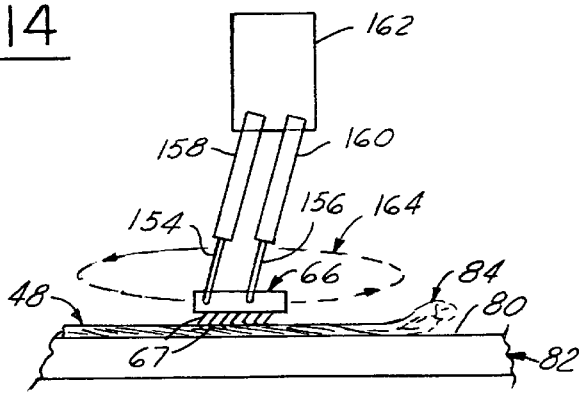
FIG. 16 is a fragmentary schematic diagram of one embodiment of a robotic apparatus for electro-mechanically performing the brushing or carding step of the method of the invention.

The brush carding operation also can be mechanized in several ways, as will be understood by those skilled in the art from the foregoing description, in order to increase the rate of production of pillows 94 or their equivalent. One example of such mechanization is shown in FIG. 16 in semi-schematic form. In this example the carding brush 66 is suitably mounted to the extensible piston rods 154 and 156 of robotic cylinders 158 and 160, which in turn are supported on a conventional robot mechanism 162 to operate in a manner of parallel linkage under suitable computer control programming in conventional fashion to thereby support card brush 66 for motion in the travel path indicated by the broken lines 164 in FIG. 16. This travel path can be programmed to simulate the hand motion described previously in conjunction with the brush carding operation of the manual method. Once a suitable pillow 84 of the brush carded fibers from the yarn array 48 has been produced automatically by the robotic brush drive mechanism, the resultant pillow 94 can be removed mechanically by suitable detection and control equipment associated with a pick-off robot mechanism (not shown) carrying a carding rake or comb for removal to a pillow collection station for further working as described previously in conjunction with stage 90 of the block diagram of FIG. 1.

Figure 17:
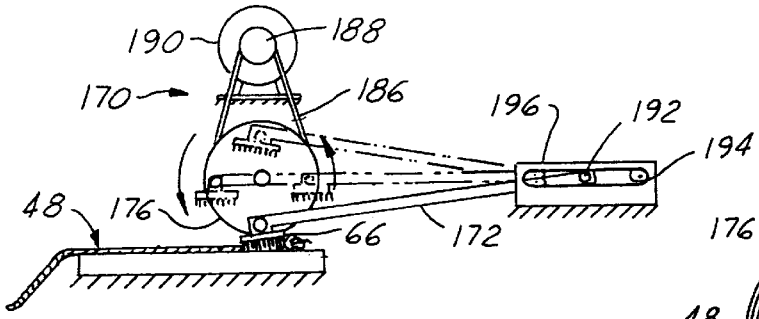
FIG. 17 is a simplified fragmentary side elevational view of another embodiment of a carding brush mechanism of the invention for performing the brushing or carding step of the method of the invention.

FIGS. 17 and 18 illustrate another embodiment of brush carding mechanism 170 of the invention apparatus 170, wherein brush 66 is affixed to a dog leg termination of the working end of a crank arm 172. An axle pin 174 extends through the working end of crank 172 and is pivotally mounted at one end in the side of a drive pulley 176. The axially opposite end of pin 174 is pivotally mounted in an idler support arm 178 which in turn is pivotally supported at its opposite end by an axle pin 180 journalled in an upright bracket 182 mounted on a support base 184 (FIG. 18). Drive pulley 176 is rotatably driven by a drive belt 186 trained at one end around pulley 176 and at the other end around a drive pulley 188 of an electric drive motor 190. As indicated schematically in FIG. 17, motor 190 may be positioned above drive pulley 176, or therebelow as indicated schematically in FIG. 18. Crank arm 172 is supported at its end remote from brush 66 by a cross pin 192 which slides in a slot 194 of a guide yoke frame 196.

In operation of apparatus 170, when pulley 176 is driven at a uniform speed of rotation (in the direction of the arrows in FIG. 17) the working end of crank arm 172 and the associated carding brush 66 will be bodily carried in the rotary path of travel indicated by the four incremental travel positions shown in FIG. 17. It will be seen that brush 66 will have an arcuate travel path as its bristles engage and draw through the free ends of the yarn strands of array 48 to work the same into the pillow 84 as shown diagrammatically in FIG. 19. It will be understood that brush 66 can be pivotally supported on the working end of crank 172 so that gravitational and/or engagement forces with the yarn strand array 48 will cause the same to assume an orientation with the brush back oriented generally parallel to the supporting surface for the yarn array 48 during a working stroke of the brush as it cards through yarn strands adjacent and then beyond their free ends.

Figure 20:
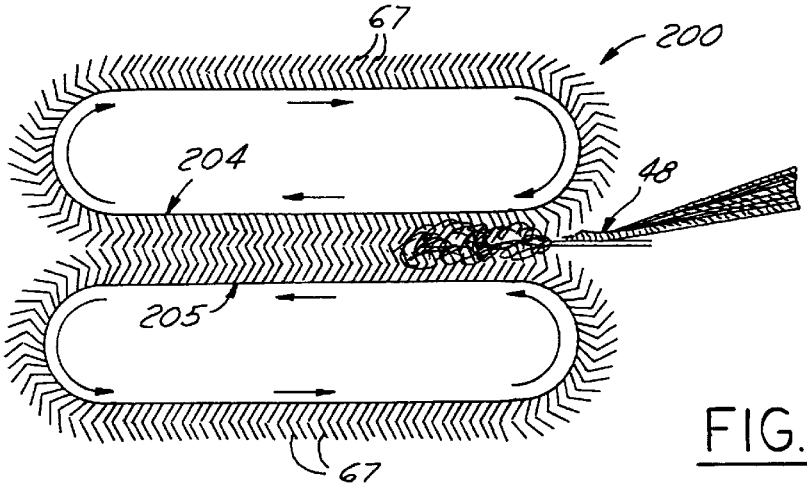
FIG. 20 is a schematic side elevational view of a first embodiment of a dual rotary brush belt mechanism for use as a further electromechanical mechanism embodiment of the invention in performing the brushing or carding of the method of the invention.
Figure 21:
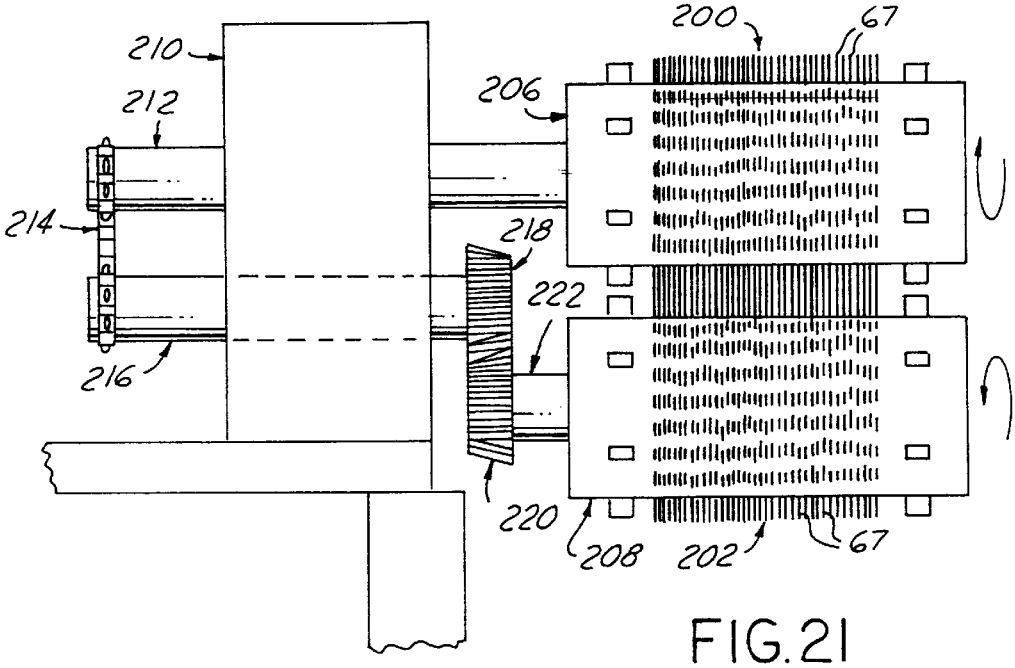
FIG. 21 is a fragmentary simplified end elevational view of the dual belt card of FIG. 20 and associated drive mechanism of the same.
Figure 22:
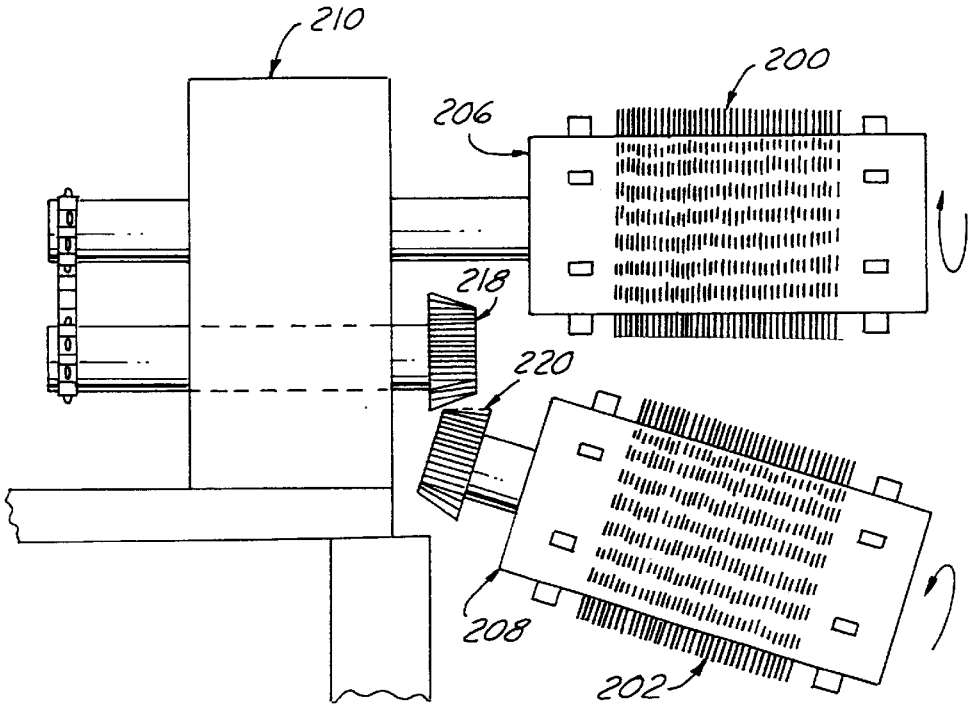
FIG. 22 is a simplified end elevational view similar to FIG. 21 but illustrating the lower belt card disengaged from the upper belt card to permit removal of the collected fibers from the wire carding cloth of each of the dual belts at the completion of the yarn card/brushing step of this apparatus embodiment for practicing this stage of the method of the invention.

Another embodiment of card brushing mechanism of the invention is shown in simplified form FIGS. 20, 21 and 22 as a first embodiment of a dual rotary brush belt mechanism. As diagrammatically illustrated in FIG. 20, a pair of oval brush belts 200 and 202 are oriented side-by-side or one above the other and counter-rotated to slightly interengage the card wire carried on the mutually adjacent runs 204 and 205 of the two belts. Each brush 200, 202 is made of card cloth sewn to a nylon belt which may be three running feet in length. The card cloth may consist of the brush bristles 67 of the type employed on brush 66 and oriented to have a forward rake in the direction of belt travel. Preferably, belts 200 and 202 are operated at the same travel speed. The yarn array 48 is fed into their upstream convergence zone of the two belt runs 204 and 205 under suitable restraint so that the yarn is brushed and carded into bristles 67 of the belts as indicated schematically in FIG. 20.

The support and drive apparatus for belts 200 and 202 is indicated semi-schematically in FIGS. 21 and 22. Belts 200 and 202 are each supported at one end by an associated cylindrical drive roll 206 and 208 respectively. The support idler rolls for the opposite end of each belt are not shown. A conventional electric motor drive and speed reducer unit 210 has an output drive shaft 212 coupled at one end to drive roll 206. The axially opposite end of shaft 212 is coupled by a sprocket and drive chain arrangement 214 to one end of a counter shaft 216 the opposite end of which carries a bevel gear 218. Another bevel gear 220 on the end of the drive shaft 222 for roll 208 is normally in driven mesh with gear 218 to thereby counter rotatably drive roll 208 at the same speed as drive roll 206.

As shown in FIG. 22 this driving arrangement for a drive roller 208 of the lower belt 202 enables the lower belt to be pivoted downwardly to decouple gears 218 and 220 and to demesh belts 200 and 202 for hand or rake unloading of the brush bristles 67 of both belts when they have each accumulated a full load of carded fibers from the yarn strand array 48. The supporting frame work for the belts 200 and 202 and associated drive brush and card rolls is conventional and therefore not shown, and is suitably articulated as will be apparent to those skilled in the art from the foregoing description to thereby permit the motion as shown from the brushes engaged position of FIG. 21 to the brushes disengaged position of FIG. 22, and vice versa.

FIGS. 23A through 36B illustrate a second embodiment of a dual rotary brush belt mechanism of the invention along with an associated infeed mechanism including a yarn guide comb and rotary nip roll and associated variable speed drive therefor located between the dual belts and the output downstream end of the feed table. In FIGS. 23A–36B, those elements previously described are given like reference numerals and their description not repeated, and those elements alike in function to those previously described are given a like reference numeral raised by a prime suffix. Also, suffix "A" and "B" are hereinafter deleted in the figure numbers when referring to FIGS. 23A–36B.

Figure 30:
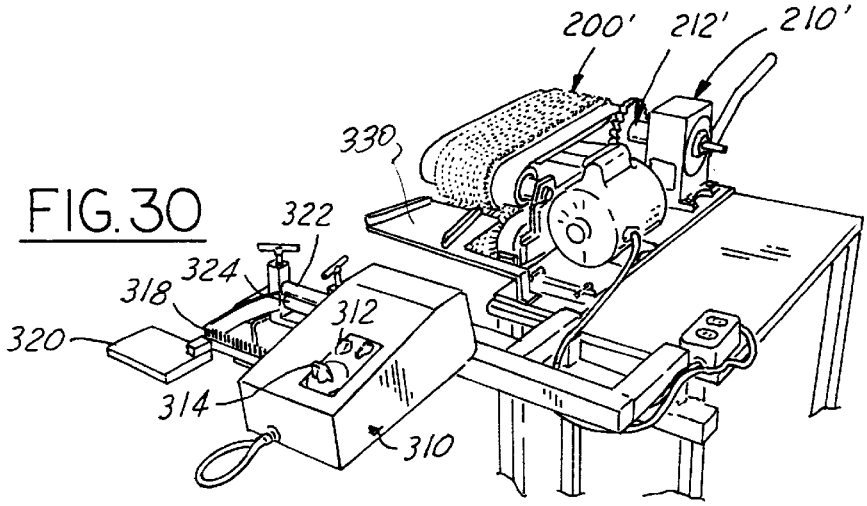
FIGS. 30A and 30B are respectively a photocopier enlargement and associated color photo print of the apparatus shown in FIGS. 29A and 29B taken from the above and from the right hand side of the apparatus.

As best seen in FIGS. 23, 27, 28 and 34, the upper and lower brush belts 200' and 202' are generally supported on a table framework 230. As best seen in FIGS. 30, 33 and 35, the electric drive motor and speed reducer unit 210' is mounted on the tabletop of framework 230 and the output shaft 212' of the speed reducer supports the drive roller 206' for the upper belt 200'. The idler roll 207' (FIG. 32) for upper belt 200' has its idler support shaft cantilevered supported in a journal bearing bracket support 232 (FIG. 26) also mounted on the tabletop. The tabletop support framework also includes a cantilevered support arm 234 (FIG. 32) that extends between the upper belt drive and idler rolls 206' and 207' and carries upper and lower stationary support plates 236 and 238 along which the upper run 240 and lower run 204 of upper belt 200' slidably travel. Plates 236 and 238 are preferably made of a suitable plastic material having a low coefficient of friction and serve to maintain the associated belt runs horizontal and flat in operation during their motion in their endless travel path as driven by drive roller 206'.

Figure 35:
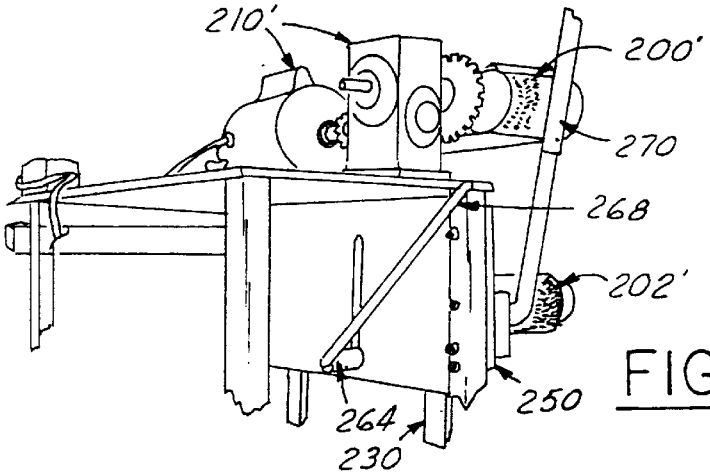
FIGS. 35A and 35B are respectively a photocopier enlargement and associated color photo print of the apparatus shown in FIGS. 32A and 32B, 33A and 33B, 34A and 34B as viewed from the right hand side and looking upstream and taken from a lower elevation.
Figure 36:
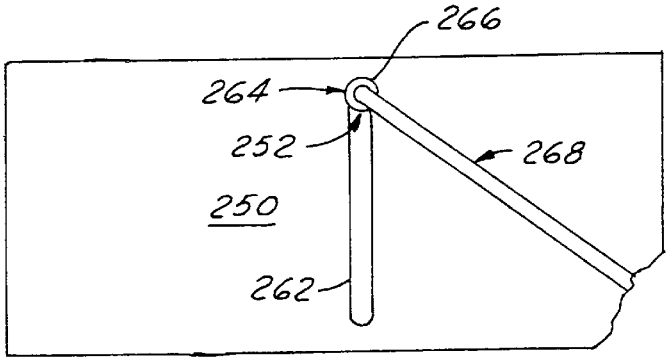
FIGS. 36A and 36B are respectively a photocopier enlargement and associated color photo print of a portion of the apparatus of FIGS. 35A and 35B taken from the right hand side and looking through the frame and illustrating the locking clamp structure associated with the lower belt carriage slide supporting structure.
Figure 37:
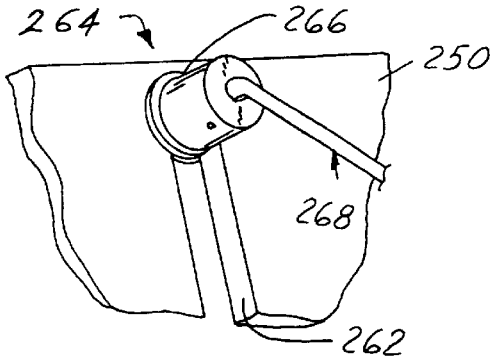
Figure 38:
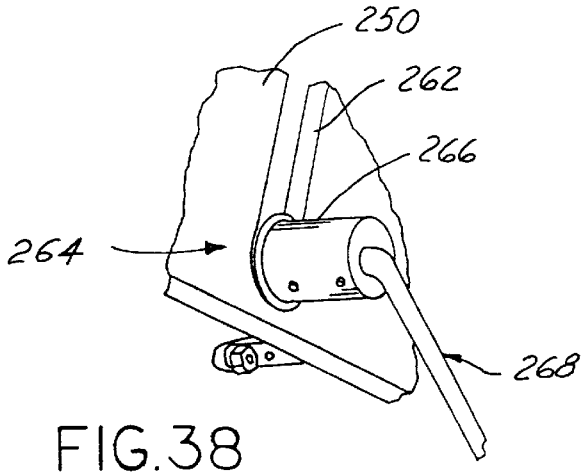
Figure 39:
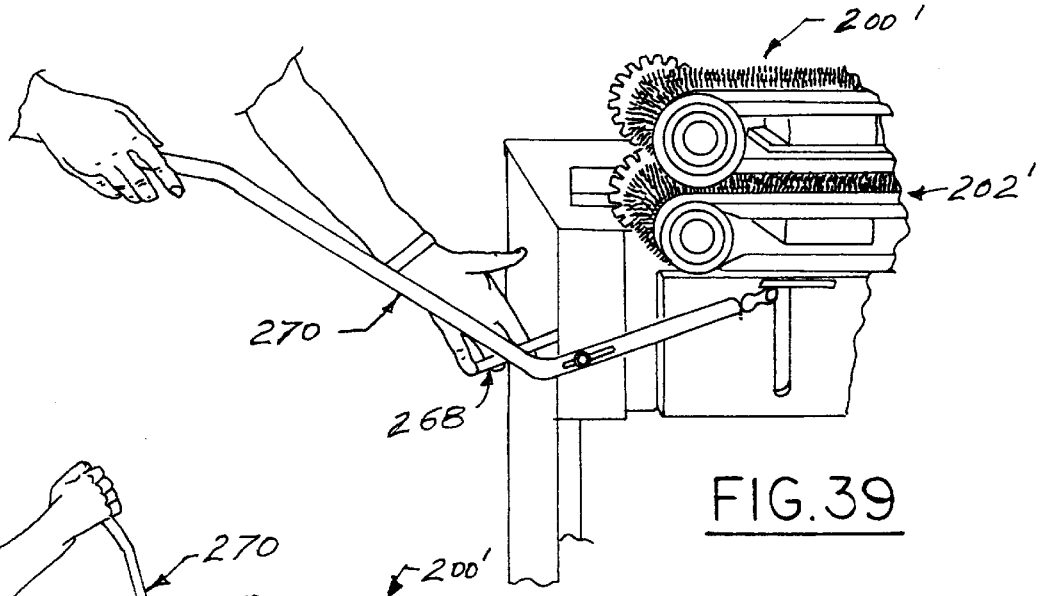
Figure 40:
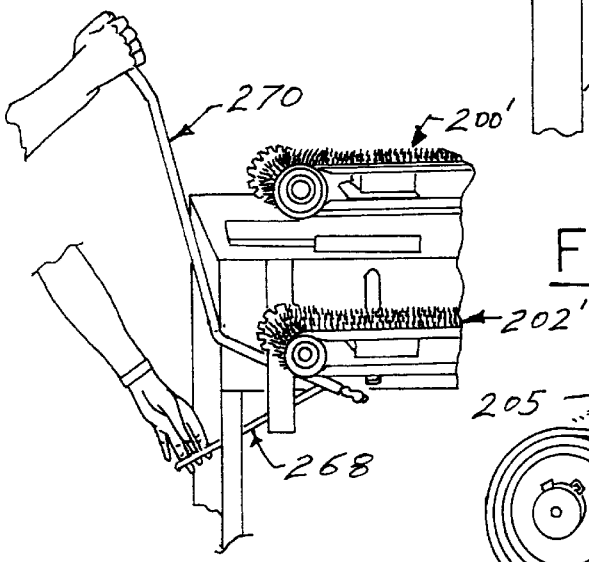
Figure 41:
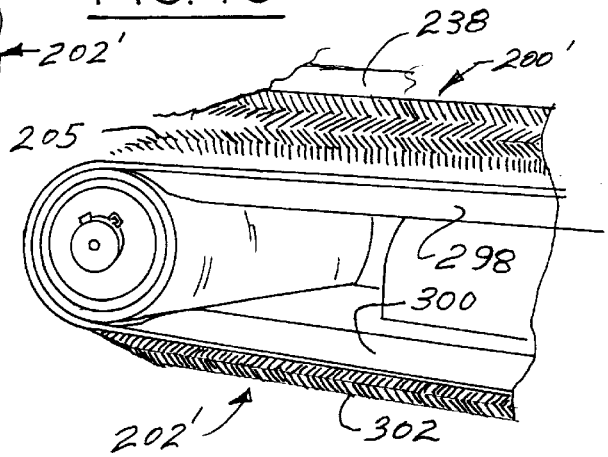
Figure 42:
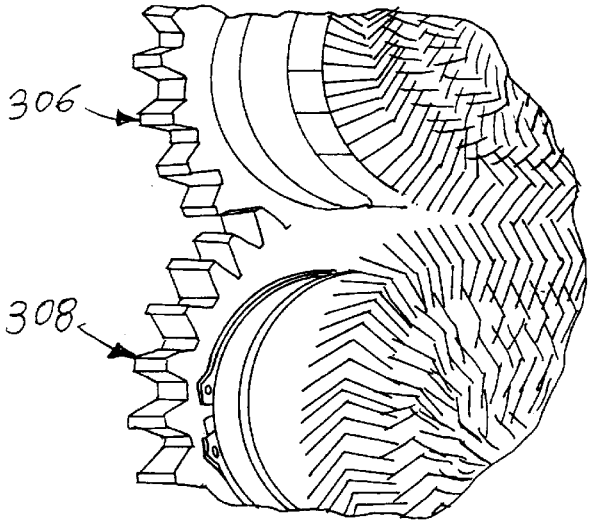

A lower belt brush 202' is supported for bodily motion vertically on a vertical slide carriage support structure mounted on the side of table framework 230. This carriage structure also includes a vertically disposed main support plate 250 fixedly mounted to one side of the table framework 230 (FIGS. 23, 32, 35, 36). The carriage structure includes a horizontally extending strut 252 secured at its longitudinally opposite ends to a pair of vertically oriented slide plates 254 and 256 (FIGS. 32, 31) that respectively slide in track grooves 258 and 260 formed in the surface of plate 250 that faces the lower brush belt 202'. Plate 250 has a vertically extending central slot through which protrudes a stud (not shown) welded at one end to cross strut 252 and forming a part of a slide clamp lock mechanism 264 (FIGS. 35, 36). The clamping stud threadably engages a threaded collar carrying a clamping flange 266 which slides along the margin of slot 262 on the side thereof opposite the belt mechanism and serves to releasably clamp the carriage to plate 250 and also serves to retain the slide plates 254, 256 in their associated slide tracks when the clamp is loosened sufficiently to release the clamping engagement of collar 266 with plate 250. An operating handle 268 is fixed at one end to the threaded member carrying collar 266 for releasing and tightening the clamping mechanism 264.

When clamp 264 is rotated to release position, the carriage strut 252 is raised and lowered by operating a bell crank lever 270 (FIGS. 23, 31, 32, 33). Bell crank 270 is pivotally supported on table framework 230 at a pivot support block 272 (FIGS. 23, 34) that carries a pivot pin 274 that protrudes through a pivot travel slot 27() in the crank arm 278 of bell crank 270. The end of crank arm 278 remote from slot 276 is pivotally coupled at 280 to a bracket 282 welded to cross strut 252. Thus, pushing downwardly on the handle 284 at the free end of the handle arm 286 of bell crank 270 will, through the resultant upward swinging motion of crank arm 278, lift the brush belt carriage upwardly slidably along support plate 250, and vice versa. Suitable stops are provided to cooperate with cross strut 252 (not shown) to set the upper limit of travel of the carriage, or the upper end of slot 262 may be designed for this purpose. Preferably, the upper limit is set to cause the card cloth 67 of the upper run 205 of lower belt 202' to be slightly intermeshed (for example 1/16" to 1/8") with the card cloth 67 carried on the lower run 204 of upper belt 200'. When clamp handle 268 is operated by swinging it downwardly to thereby release clamp 264, and then bell crank 270 operated by swinging its handle 284 upwardly to thereby drop lower belt 202' to its lowermost open position shown in FIGS. 32–35, easy access is obtainable to both the upper and lower belts 200' and 202' for removal of two accumulated fluff product batts, one from each card clothing of the associated belts.

The drive roll 208' for lower belt 202' is journalled on a stud shaft cantilevered from strut 252, and likewise as to the idler roller 296 for lower belt 202'. Also, stationary flat support plates 298, 300 are supported by an arm frame 302 cantilevered from strut 252 for respectively slidably supporting the upper run 205 and lower run 302 of belt 202' (FIG. 32) during their travel therealong. The lower belt drive roller 208' is slave driven off the upper belt drive roller 206' by means of a pair of spur gears 306 and 308 (FIG. 33) respectively mounted on the shafts of rollers 206' and 208'. Gears 306 and 308 are suitably oriented to drivingly mesh when the lower belt is raised to its uppermost position shown in FIGS. 23, 26–31. Preferably, gears 306 and 308 are equal in diameter and number of teeth so that the upper and lower belts are driven at a 1:1 travel rate ratio.

Figure 28:
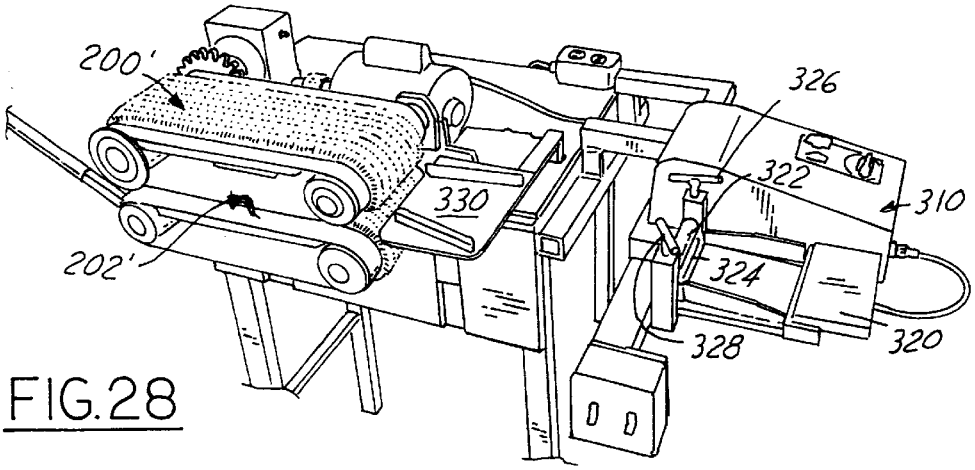
FIGS. 28A and 28B are respectively a photocopier enlargement and associated color photo print showing the yarn guide comb and variable speed nip roll mechanism and associated dual rotary brush belt mechanism of the apparatus of FIGS. 23A and 23B shown from above and to the left of the apparatus without yarn material entrained therein.
Figure 29:
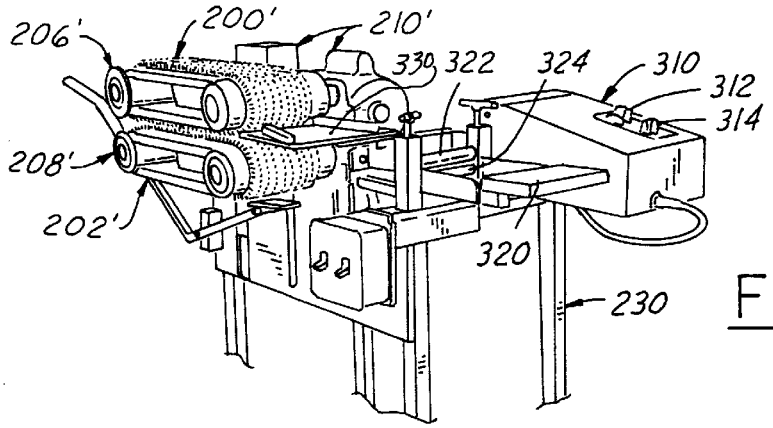
FIGS. 29A and 29B are respectively a photocopier enlargement and associated color photo print of the apparatus shown in FIGS. 28A and 28B also taken from the left hand side at a slightly lower elevation from above.
Figure 46:
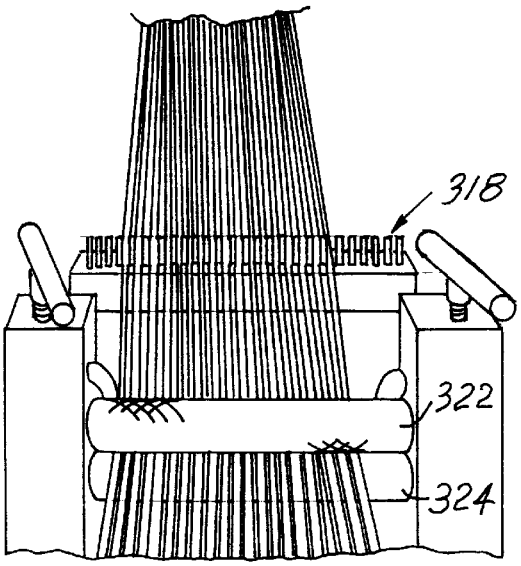
Figure 47:
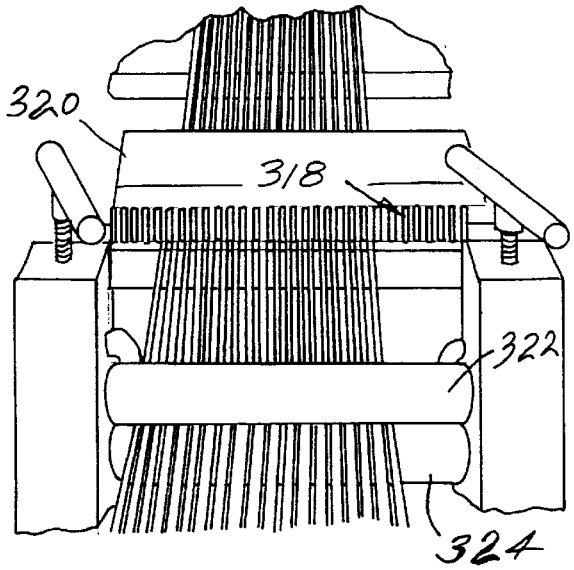
Figure 48:
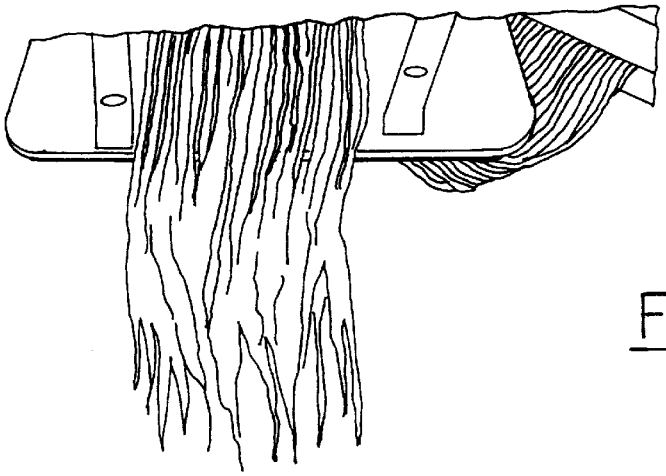
Figure 49:
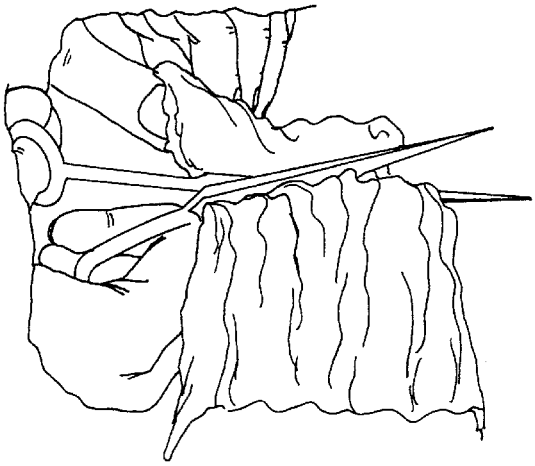

A multiple yarn strand infeed mechanism is also provided upstream of the carding belts 200' and 202' as best seen in FIGS. 25, 26, 28–33. This infeed mechanism includes a commercially available variable speed drive unit 310 cantilevered mounted on the upstream end of table framework 230 and provided with drive speed controls 312 and 314 (FIGS. 29, 30). A comb guide bar 316 is cantilevered off the left side of unit 310 to underlie the feed path of multiple yarn strand array 48 and is provided with a row of upright comb pins 318 (FIG. 30) for inserting the yarn strands individually therebetween. A pivoted cover plate 320 is supported off the free end of bar 316 so that it can be swung to a comb-open position (shown in FIGS. 25 and 30) to a comb-closed position and lying on top the yarn strands to thereby pass down lightly and thereby capture the yarn strands as they feed into and through the associated comb teeth (shown in FIGS. 45,46 and 47).

A pair of knurled nip rolls 322, 324 are operably mounted on table 230 and located downstream of the guide comb adjacent the downstream end of drive unit 310. The lower nip roll 324 is power driven and journalled in fixed position by unit 310, whereas the upper nip roll 322 is an idler that can be raised or lowered by rotating the screw jack handles 326 and 328 to thereby raise and lower the bearing blocks in their associated slide posts that in turn support the opposite ends of idler nip roll 322. The upper nip roll 322 is preferably adjusted to exert just a light frictional clamping pressure on the yarn strands being fed between the nip rolls to thereby produce a sufficient friction grip drive on the yarn strands to pull them from the feed table output end and feed them at a controlled feed rate to the input end of the dual rotary brush belt carding mechanism.

An apron platform 330 (FIGS. 25, 26, 28, 29, 30) is stationarily mounted at the elevation of the convergence zone of the upper and lower belts 206', 202' at their upstream ends to thereby assist yarn feed setup and to guide the yarns as they are draw fed by and into the card cloth of the belts. Suitable boundary guides 332, 334 are mounted on apron 330 to converge in the downstream direction to further assist in guiding the strand array 48 into the belts (FIGS. 28, 33).

It will be seen that belts 200' and 202' operate in the manner previously described in conjunction with belts 200 and 202 to accumulate a carded continuous batt in the form of an endless loop belt of fiber fluff on the card cloth of each belt. Preferably the dual rotary brush belts are operated to travel at a linear speed of about 1.56 feet per second during the carding and fiber fluff batt formation on the card cloth of each belt. Preferably the nip rolls are operated through the driving of the lower driven nip roll 324 to feed the yarn strand array 48 therethrough at a rate of 8 inches per minute. For a typical coded pattern of multiple yarn strands of say for example 20–26 strands at these feed and carding rates, the card cloth of the belts will become fully loaded in a matter of about 12 minutes. Overloading is to be avoided since the material tends wad or ball up under overload conditions. Hence, at the appropriate end of the cycle time for achieving proper loading of the belts with carded fluff fibers drawn from the yarn strands as described previously, the drive units 210, 310 are stopped. Then release lever 268 is swung upwardly from its lower locked position to its upper release position, thereby allowing the lower belt carriage to be dropped by simultaneously operating the bell crank 270 to raise its handle 284 from its lowermost position shown in FIG. 23 to its uppermost position shown in FIG. 32.

Figure 50:
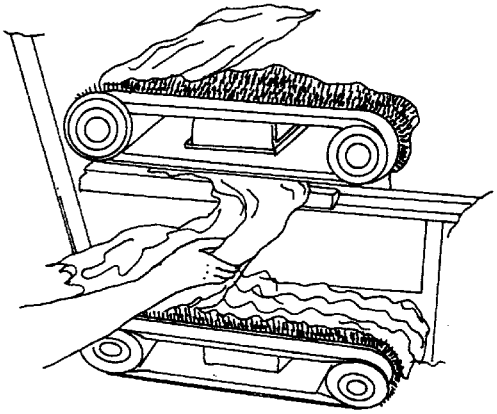
Figure 51:
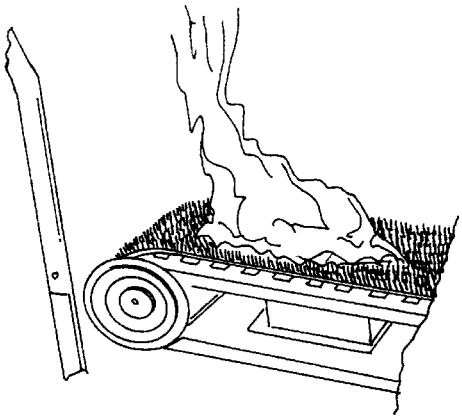
Figure 52:
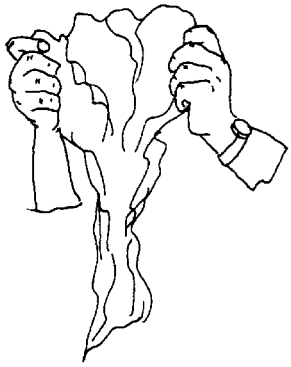
Figure 53:
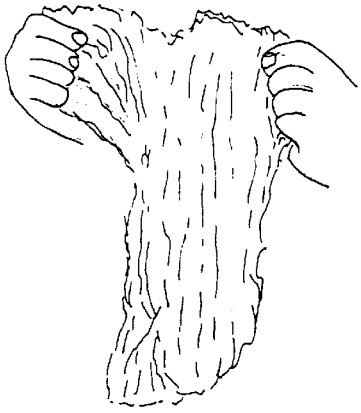
Figure 54:
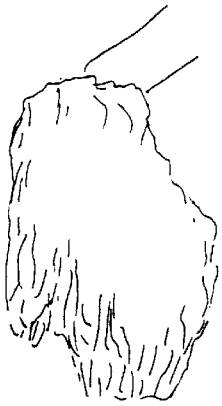
Figure 55:
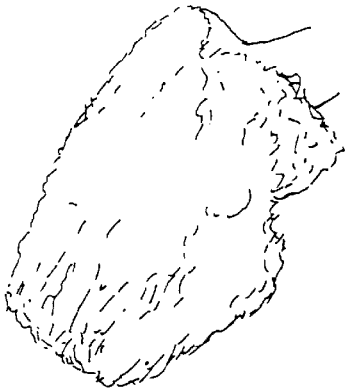
Figure 56:
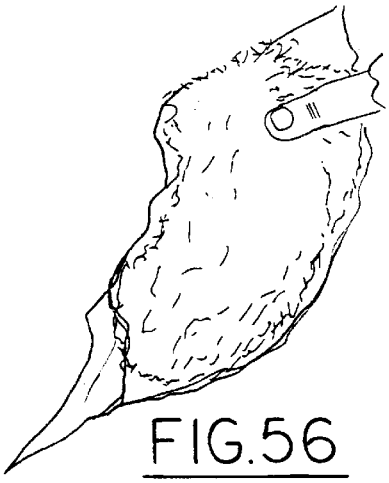

Then the accumulated endless batt of carded fibers is removed from the associated brush belt by cutting across it with scissors, then grabbing the loose ends and hand stripping the batt from the card cloth to thereby provide a coherent length (say about 36") of fiber fluff material, as shown in FIGS. 50 and 51. Preferably this batt is loosely shaken a few times, given a two handed lateral stretch to widen the batt, folded over or twice lengthwise, possibly also twisted once or twice, and then stuffed into a suitably sized clear plastic bag ready for storage, shipment, sale, display and/or use as decorative fiber fluff material. Alternatively, the batt, either as pulled off the card clothing or as so further worked, is fed into a conventional yarn spinning apparatus to form a variegated multi-color yarn as described previously. Such yarn then may be used to make knitted fabric by conventional fabric knitting process and apparatus, and to further make wearing apparel from the same as described previously.

Figure 58:
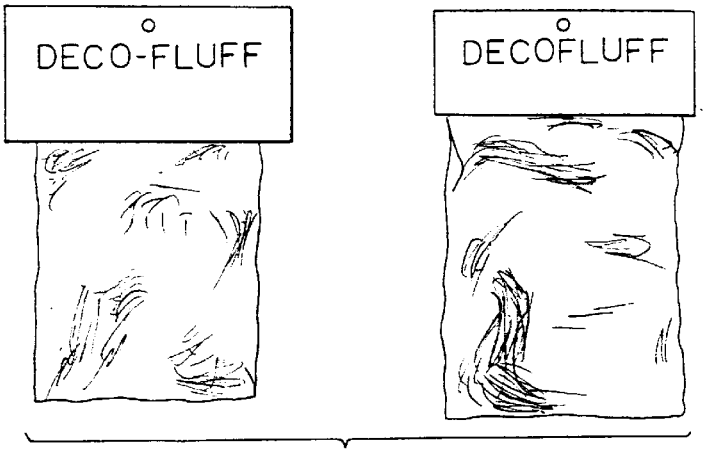
Figure 57:
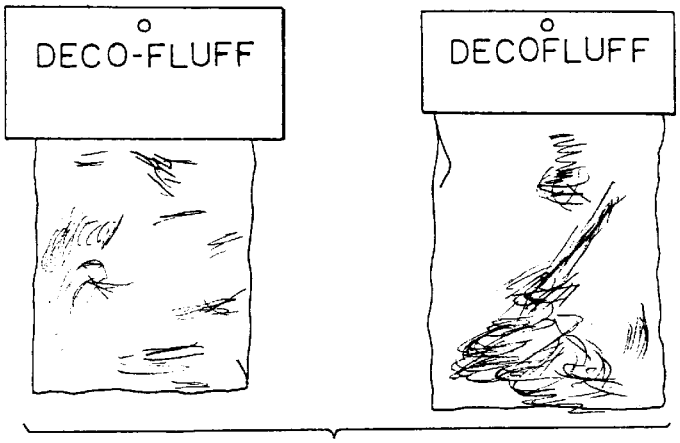
Figure 59:
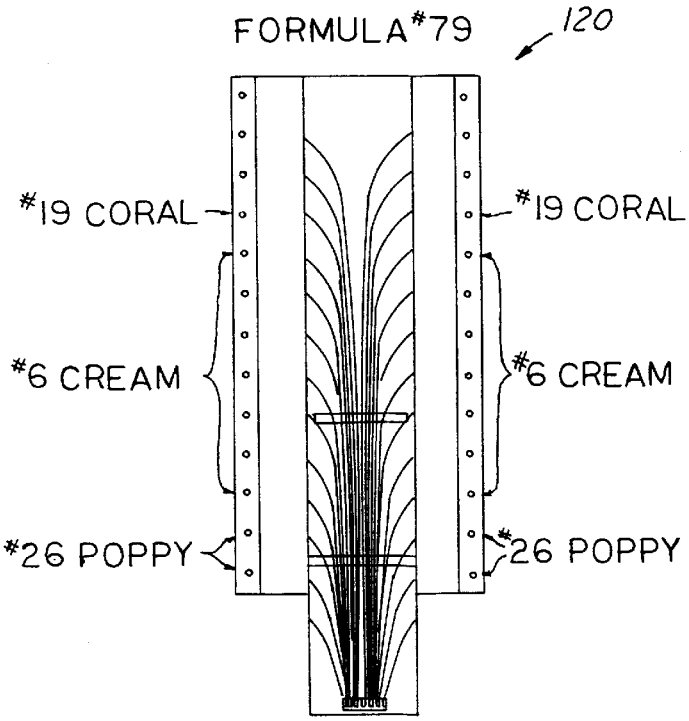
Figure 60:
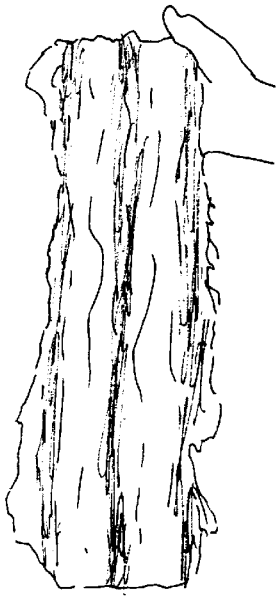

It will be noted that the carded batt made on the apparatus of the second embodiment of the dual rotary brush belt mechanism has a more noticeable streaked appearance than the fiber fluff made by hand method that results in a material shown in FIG. 11 and described previously. The appearance of such an exemplary fiber fluff batt is shown in FIGS. 57 and 58.

It is further contemplated that conventional textile carding machinery and equipment already available can be readily modified in accordance with the foregoing disclosure to perform the method of the invention and to provide in accordance with the invention the novel decorative fluff products, such as the decorative fluff mass 92, and, of course, the novel decorative yarn spun therefrom and the novel knit fabrics and novel wearing apparel or other novel articles made from the novel yarn so spun. For example, it is contemplated that a conventional large carding engine can be employed to perform the stages corresponding to stages 30–36, 46 and 50 of the process block diagram of FIG. 1 in lieu of the initial manual or hand method set forth previously hereinabove. With such equipment, the starting material may be multi-ply yarn as in the hand method fed to the carding cloth of the carding roll to be suitably brushed and carded therein by working and/or fancy rollers and the like. Preferably, the infeed yarn strands are arrayed in a manner similar that of the feed table apparatus described in conjunction with FIGS. 12–15 and 18 so that with the two-color and three-color majority of the color-coded yarn formula the color of yarn having highest contrast with the base yarns (customarily white or pale in color) are fed in a concentrated manner to the carding cloth so that one or more distinct bands of color appears on the carding cloth among the major color of yarn fibers being carded thereon. The carding engine is equipped and run to produce a carding and brushing action on the infeed stock in the manner described previously to extract the fibers from the yarn stock and to partially intermingle and blend them on the card cloth of the main card roll or cylinder. In other words, complete intermingling or blending of the various starting colors is not desired. Rather color streaks will still remain visible on the card cloth of the main card cylinder as the carding and blending operation is performed thereon.

The output end of the card cylinder may consist of the conventional doffer roll operable to extract the fibers from the card cloth of the main cylinder, and then the fibers removed from the doffer by a conventional card or doffer rake or comb which collects and forms the removed fibers into a loosely continuous roving or sliver of very low density. Such roving would have an appearance similar to the pillows 94 but, of course, greatly elongated in axial dimension. If the input array of yarns is to be pattern repeated axially along the input side of the main card roll, the axial dimension of the card should be sufficient to permit a given formula color code array to be repeated several times side-by-side across the input of the card roll. Hence, the output roving would resemble a series of pillows 84 axially interconnected end-to-end.

The output roving or sliver may then be worked in a batch process similar to the process described in conjunction with stage block 90 to produce the random candy-cane effect of the bands, swirls, islands and so on of the contrast color as highlights in the main base color. In other words the sequence illustrated schematically in FIG. 7 can be performed by conventional suitable machinery adapted to this purpose in accordance with the foregoing description. A straightforward mechanical duplication of the manual process involves computer controlled robotic arms and hands simulating the previously described hand motion of rotation, stretching, pulling and working up of the pile of pillows, now a similar pile of rovings, into a large batch or mass of fluff to be fed to separating machinery to be formed therein into small fluff bundles or globs each similar to fluff mass 92. The output from this stage also could be fed directly to conventional yarn spinning machines to make the aforementioned randomly variegated yarn from which knit or woven fabrics and wearing apparel or other fabric articles are to be fashioned in accordance with the previously described exemplary method and product examples procedure.

Another example of automated mechanized working for stage 90 would be to feed the variegated roving or sliver output from the carding stage into a large paddle mixer tub arranged similar to the typical washing machine equipped with an agitator paddle in the operable to create randomization of the highlight streak of color and to tear apart the streaked fibrous mass and thus produce the dispersion effect seen in the fluff mass 92.

It is also contemplated that the infeed stock to the carding cylinder not be multiply strands of yarn but rather the starting stock from which such yarn is made, i.e. single color rovings made of carded staple fibers with such rovings or sliver of different colors fed side-by-side in a color coded pattern array formulation corresponding to that of the yarn input code for the selected formula. Of course, the carding engine and workers and/or fancy wheels as typically associated with the same in a conventional manner are operably adjusted in accordance with the nature of the input stock to achieve the desired partial blending and retention of highlight streaking in the output roving or sliver accumulated from the downstream end of this machinery.

Likewise, in the downstream processing equipment for stage 90, the sliver output from the carding engine alternatively is fed continuously into a macro-tear-off machine with a paddle-wheel array of comb-type implements carried for bodily rotary travel about a vertical axis of rotation and operated to tear-off clumps of the roving and drop them onto a moving conveyor belt disposed below the array. The clumps then would be fed by the belt to a kneading machine into which the clumps are fed as a continuous stream in contact with one another. Such kneading machinery, for example, comprises loosely intermeshed large pitch helical gear teeth having a counter rotational motion with differential speeds of rotation to produce a kneading and twisting action in the fluff material being processed therethrough. The output from this stage is then collected in a suitable array for feed to a packaging operation, or alternatively to a spinning operation.

I claim:

1. A method of making a decorative mass of fiber fluff comprising the steps of:

(a) providing a source of supply of staple fibers made of natural or synthetic textile fiber and arranged in continuous form as a pattern array of discrete streams of different selected colors with the colors being uniform in each stream and comprising at least one base color and one contrasting color, (b) feeding the array stream of fibers into a carding operation wherein the fibers are brushed or carded from their input form into card or brush clothing to thereby only partially intermix fibers of at least two different colors in the bristles or wires of the card or brush clothing, (c) removing the accumulated fibers from the clothing to form a pillow or roving having a streaked appearance representative of the original colors with a partial intermixing and blending of the streaks of one color with those of another, and (d) accumulating and working a pillow or roving into a final fluff product having randomly dispersed bands, streaks and islands of one color softly merging into another color to produce a decorative candy-cane like appearance in the mass of final fiber fluff product.

2. The method of claim 1 wherein step (a) comprises providing the source of supply of staple fibers in yarn form arranged as discrete strands of yarn each of a given color coordinated and selected to form an array of side-by-side yarns to form the discrete streams of different selected colors.

3. The method of claim 2 wherein step (a) further comprises providing each of the yarns as a winding on an associated spool from which the yarn may be drawn by unwinding from the spool.

4. The method of claim 3 wherein step (a) further comprises arranging the spools on spindles and number coding spools to the color code of the selected colors in accordance with a pre-selected coding pattern of input for the decorative mass of fiber fluff to be made by the method.

5. The method of claim 4 wherein the individual yarns are drawn from the associated spool winding to a convergence zone wherein an array of yarns is formed in a predetermined feed pattern to thereby provide the pattern array of discrete streams of different selected colors of staple fibers in yarn form with the yarns being fed as an array of closely spaced parallel strands of yarn into the carding operation step (b).

6. The method of claim 1 wherein step (a) comprises providing a generally parallel array of strands of yarn of the selected colors arranged side by side, and step (b) comprises feeding the array of yarns into a carding mechanism comprising two endless brush belts, each carrying card clothing and arranged with mutually adjacent runs in closely spaced parallel orientation with the card clothing on each run slightly intermeshing, and wherein the array of strands are fed into the convergence zone where the two adjacent runs converge for travel adjacent one another.

7. The method of claim 6 wherein the endless card belts are operated to travel at the same linear speed with little or no relative motion between the two mutually adjacent runs of the belt.

8. The method of claim 7 wherein the endless card belts are mounted for relative bodily motion between open and closed positions, the belt motion being stopped to move the belts to open position for unloading of the accumulated mass of carded fibers as an elongated batt from the associated card clothing of each belt to thereby perform step (c).

9. The method of claim 8 wherein step (a) further comprises providing each of the yarns as a winding on an associated spool from which the yarn may be drawn by unwinding from the spool.

10. The method of claim 9 wherein step (a) further comprises arranging the spools on spindles and number coding spools to the color code of the selected colors in accordance with a pre-selected coding pattern of input for the decorative mass of fiber fluff to be made by the method.

11. The method of claim 10 wherein the individual yarns are drawn from the associated spool winding to a convergence zone wherein an array of yarns is formed in a predetermined feed pattern to thereby provide the pattern array of discrete streams of different selected colors of staple fibers in yarn form with the yarns being fed as an array of closely spaced parallel strands of yarn into the carding operation of step (b).

12. The method of claim 11 wherein the yarn strands are fed in the parallel strand array into a pair of nip rolls disposed upstream of the convergence zone of the brush belts and operated at a predetermined controlled rate to draw the array strands into the nip rolls and feed to the brush belts, the nip rolls being operated to allow the strands to travel from the nip rolls into the convergence zone at a rate less than the rate of travel of the clothing on the brush belts.

13. The method of claim 12 wherein the yarn strands are fed through a comb guide disposed upstream of the nip rolls with each array strand being individually fed between a pair of associated comb fingers to thereby orient the array strands in a side-by-side parallel array for feed into the nip rolls.

14. A decorative mass of fiber fluff product made by the method of claim 1.

15. A decorative mass of fiber fluff product made by the method of claim 11.

* * * * *

UNITED STATES PATENT AND TRADEMARK OFFICE

CERTIFICATE OF CORRECTION

PATENT NO. : 6,112,384
DATED : September 5, 2000
INVENTOR(S) : Barnes

It is certified that error appears in the above-identified patent and that said Letters Patent is hereby corrected as shown below:

Column 3,
Line 8, delete “2” (first occurrence) and insert therein -- 3 --
Line 55, delete “multiple yarn,” and before “feed” insert -- multiple yarn --

Figure 23:
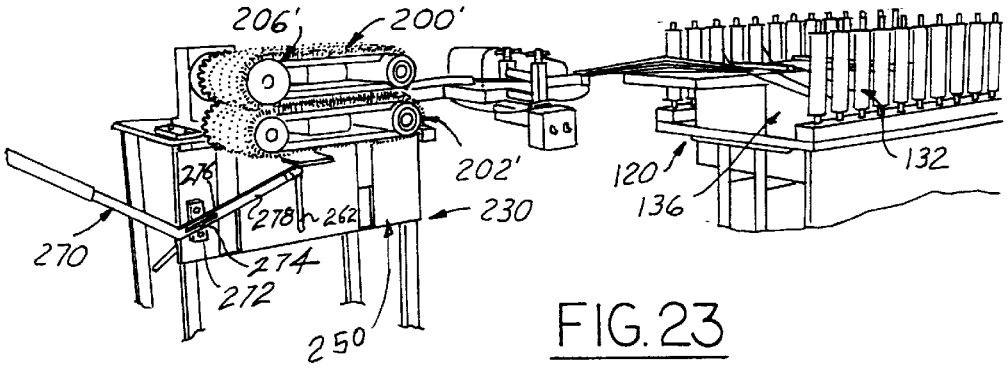
FIGS. 23A and 23B are respectively a photocopier enlargement and associated color photo print showing in perspective elevation a second working embodiment of a dual rotary brush belt mechanism and associated nip roll and comb guide infeed mechanism operably coupled downstream to the output end the multiple yarn spool feed table setup of FIGS. 12–15.
Figure 24:
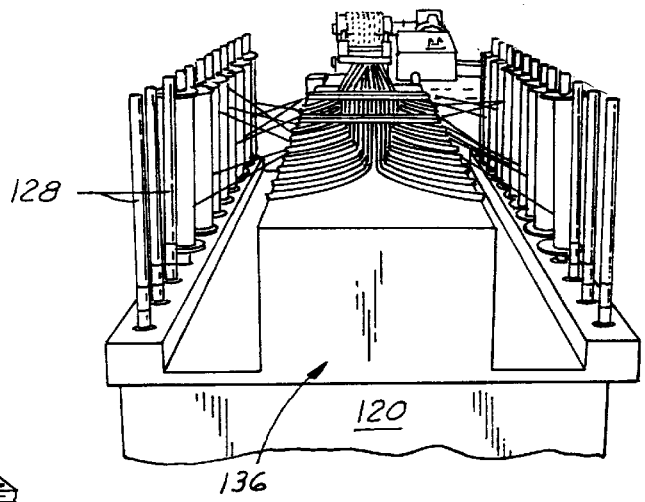
FIGS. 24A and 24B are respectively a photocopier enlargement and associated color photo print of the upstream end of the apparatus shown in FIGS. 23A and 23B.
Figure 25:
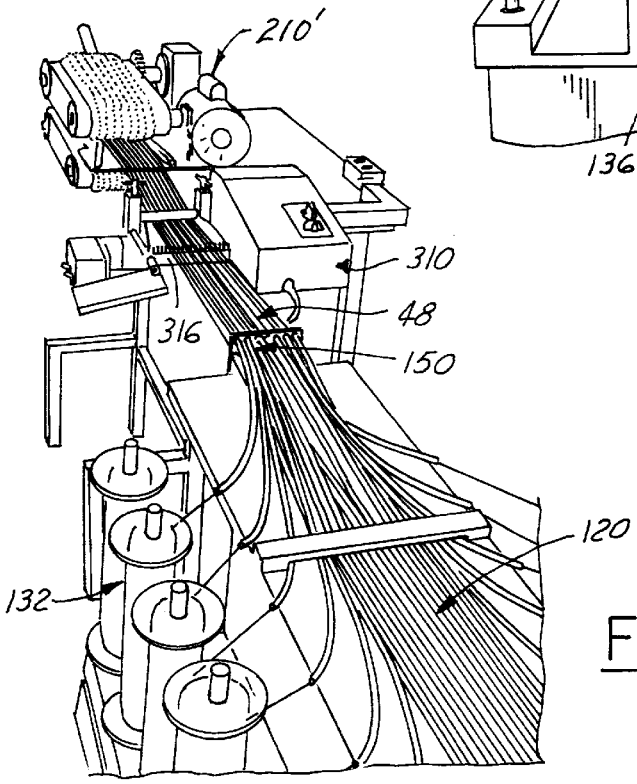
FIGS. 25A and 25B are respectively a photocopier enlargement and associated color photo print showing in perspective from above and looking downstream at the apparatus of FIGS. 23A and 23B.
Figure 26:
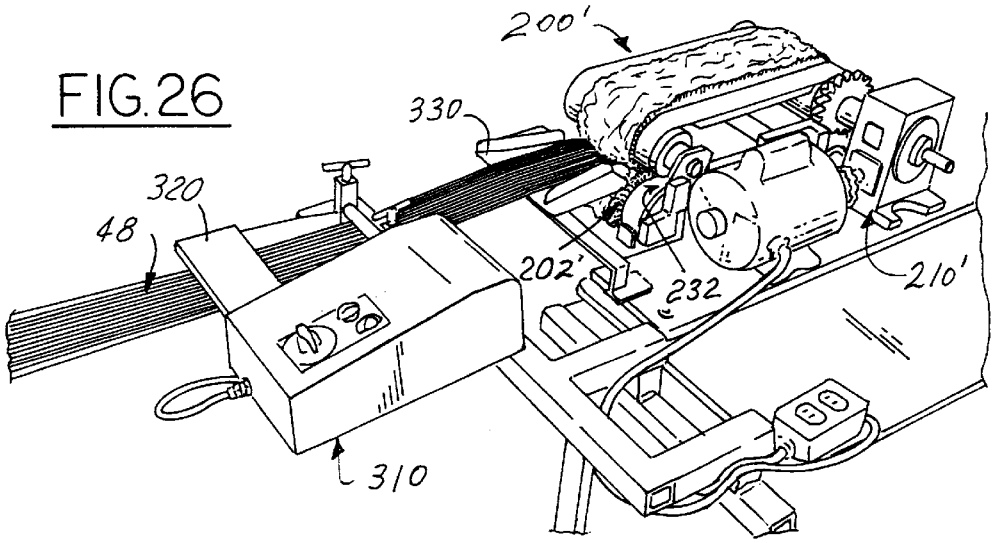
FIGS. 26A and 26B are respectively a photocopier enlargement and associated color photo print of the guide comb, variable speed nip roll and dual rotary brush belt mechanism of FIGS. 23A and 23B shown in perspective from above and to the right of the apparatus.
Figure 27:
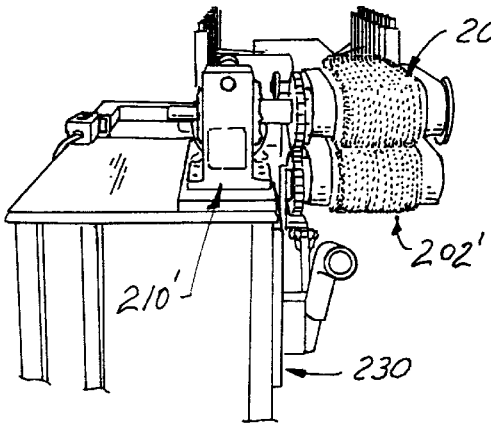
FIGS. 27A and 27B are respectively a photocopier enlargement and associated color photo print of the downstream end of the apparatus shown in FIGS. 23A and 23 B.

Column 4,
Lines 8-9, delete “FIGS. 23A and 23B are respectively a photocopier enlargement and associated color photo print” and insert therein -- FIG. 23 is a simplified fragmentary view --
Lines 15-16, delete "FIGS. 24A and 24B are respectively a photocopier enlargement and associated color photo print" and insert therein -- FIG. 24 is a fragmentary simplified perspective view --
Line 17, delete "FIGS. 23A and 23B" and insert therein -- FIG. 23 --
Lines 18-19, delete "FIGS. 25A and 25B are respectively a photocopier enlargement and associated color photo print" and insert therein -- FIG. 25 is a fragmentary simplified view --
Line 21, delete "FIGS. 23A and 23B" and insert therein -- FIGS. 23 and 24 --
Lines 22-23, delete "FIGS. 26A and 26B are respectively a photocopier enlargement and associated color photo print" and insert therein -- FIG. 26 is a fragmentary simplified perspective view --
Line 26, delete "FIGS. 23A and 23B" and insert therein -- FIG. 23 --
Lines 28-29, delete "FIGS. 27A and 27B are respectively a photocopier enlargement and associated color photo print" and insert therein -- FIG. 27 is a fragmentary simplified perspective view --
Line 30, delete "FIGS. 23A and 23B" and insert therein -- FIG. 23 --
Lines 31-32, delete "FIGS. 28A and 28B are respectively a photocopier enlargement and associated color photo print" and insert therein -- FIG. 28 is a fragmentary simplified perspective view --
Line 35, delete "FIGS. 23A and 23B" and insert therein -- FIG. 23 --

UNITED STATES PATENT AND TRADEMARK OFFICE

CERTIFICATE OF CORRECTION

PATENT NO. : 6,112,384
DATED : September 5, 2000
INVENTOR(S) : Barnes

It is certified that error appears in the above-identified patent and that said Letters Patent is hereby corrected as shown below:

Column 4 cont'd,

Lines 37-38, delete "FIGS. 29A and 29B are respectively a photocopier enlargement and associated color photo print" and insert therein -- FIG. 30 is a fragmentary perspective view --

Line 39, delete "FIGS. 28A and 28B" and insert therein -- FIG. 28 --

Lines 41-42, delete "FIGS. 30A and 30B are respectively a photocopier enlargement and associated color photo print" and insert therein -- FIG. 30 is a fragmentary perspective view --

Line 43, delete "FIGS. 29A and 29B" and insert therein -- FIG. 29 --

Figure 31:
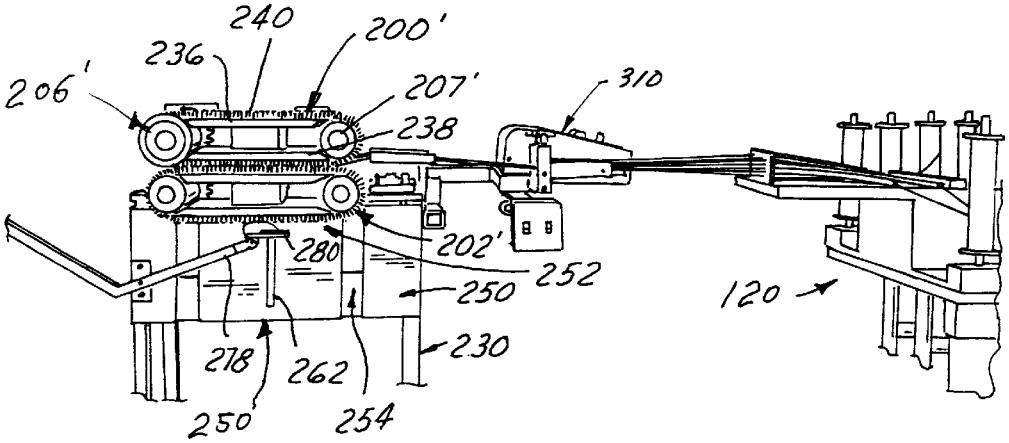
FIGS. 31A and 31B are respectively a photocopier enlargement and associated color photo print illustrations in elevation of the portions of the apparatus set up shown in FIGS. 25A and 25B with the dual rotary brush belt mechanism in closed carding engagement position.

Lines 45-46, delete "FIGS. 31A and 31B are respectively a photocopier enlargement and associated color photo print illustrations" and insert therein -- FIG. 31 is a fragmentary simplified perspective view showing --

Line 48, delete "FIGS. 25A and 25B" and insert therein -- FIG. 25 --

Figure 32:
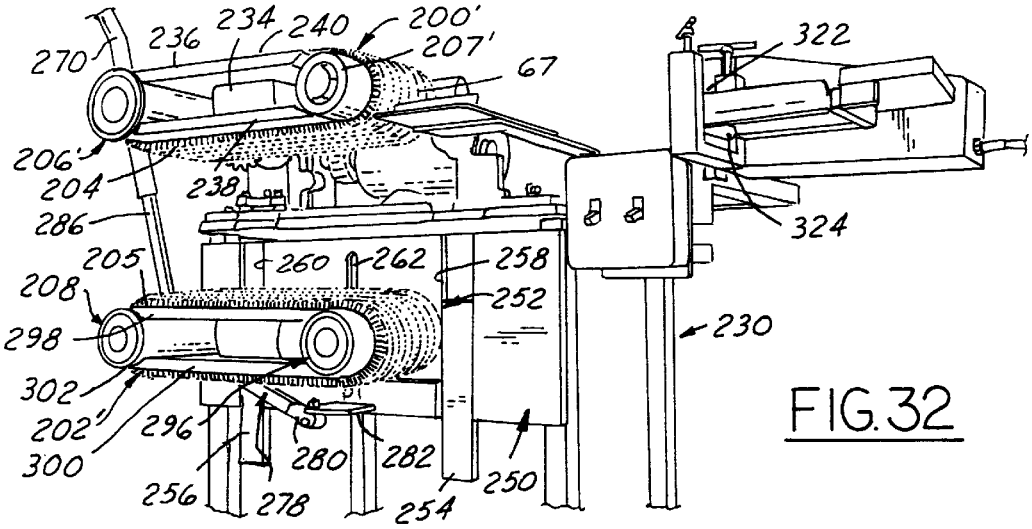
FIGS. 32A and 32B are respectively a photocopier enlargement and associated color photo print of the portion of the apparatus shown in FIGS. 28A and 28B shown from the left hand side looking downstream with the dual rotary brush belts shown separated and open in their material removal position.
Figure 33:
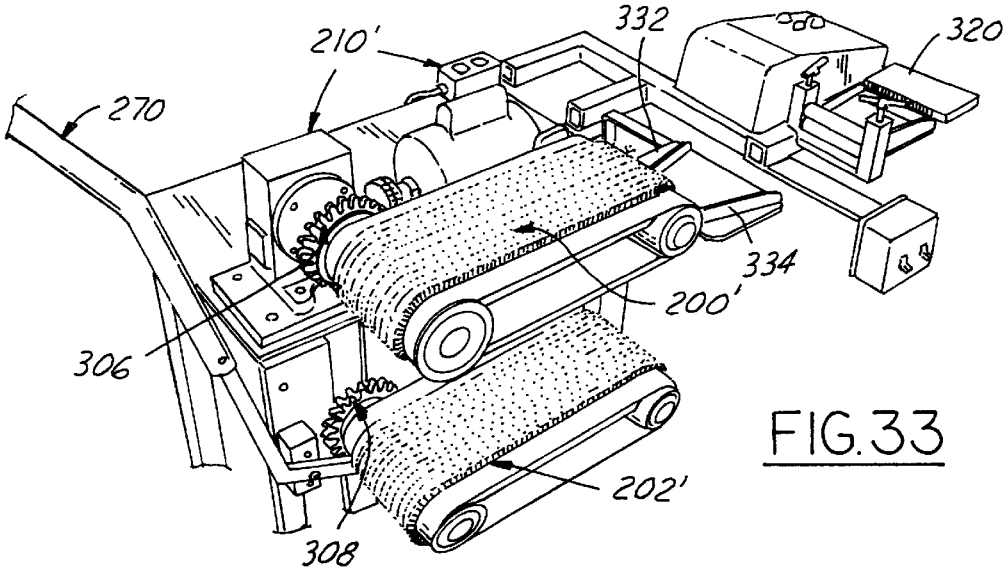
FIGS. 33A and 33B are respectively a photocopier enlargement and associated color photo print of the apparatus shown in FIGS. 32A and 32B shown from the left hand side looking upstream and from above.

Lines 50-51, delete "FIGS. 32A and 32B are respectively a photocopier enlargement and associated color photo print" and insert therein -- FIG. 32 is a fragmentary simplified perspective view --

Line 52, delete "FIGS. 28A and 28B" and insert therein -- FIG. 28 --

Lines 56-57, delete "FIGS. 33A and 33B are respectively a photocopier enlargement and associated color photo print" and insert therein -- FIG. 33 is a fragmentary simplified perspective view --

Line 58, delete "FIGS. 32A and 32B and insert therein --FIG. 32 --

Figure 34:
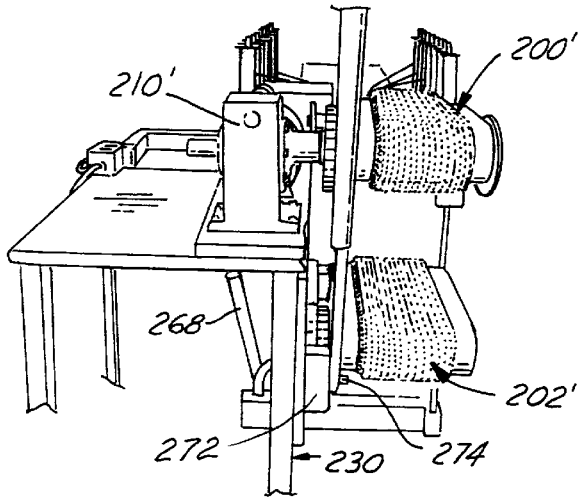
FIGS. 34A and 34B are respectively a photocopier enlargement and associated color photo print of the apparatus shown in FIGS. 32A, 32B and 33A, 33B as viewed from the downstream end looking upstream.

Lines 60-61, delete "FIGS. 34A and 34B are respectively a photocopier enlargement and associated color photo print" and insert therein -FIG. 34 is a fragmentary simplified perspective view --

Line 62, delete "FIGS. 32A, 32B and 33A, 33B" and insert therein -- FIGS. 32 and 33 --

Lines 64-65, delete "FIGS. 35A and 35B are respectively a photocopier enlargement and associated color photo print" and therein -- FIG. 35 is a fragmentary simplified perspective view --

Line 66, delete "FIGS. 32A and 32B, 33A and 33B" and insert therein -- FIGS. 32, 33 and 34 --

UNITED STATES PATENT AND TRADEMARK OFFICE

CERTIFICATE OF CORRECTION

PATENT NO. : 6,112,384
DATED : September 5, 2000
INVENTOR(S) : Barnes

It is certified that error appears in the above-identified patent and that said Letters Patent is hereby corrected as shown below:

Column 5,
Lines 3-4, delete "FIGS. 36A and 36B are respectively a photocopier enlargement and associated color photo print" and insert therein -- FIG. 36 is a fragmentary simplified perspective view --
Line 5, delete "FIGS. 35A and 35B" and insert therein -- FIG. 35 --
Line 9, delete "color photo prints" and insert therein -- simplified views --
Line 58, delete "FIGS." and insert therein -- FIG. --
Line 58, delete "and 60 are respectively" and insert therein -- is --
Line 59, delete "and color photo print"
Line 62, delete "illustrating" and insert therein -- illustrates --

Signed and Sealed this

Eighth Day of July, 2003

JAMES E. ROGAN
*Director of the United States Patent and Trademark Office*